US006235129B1

(12) United States Patent
Kojima et al.

(10) Patent No.: US 6,235,129 B1
(45) Date of Patent: May 22, 2001

(54) HARD MAGNETIC MATERIAL

(75) Inventors: Akinori Kojima; Akihiro Makino; Takashi Hatanai; Yutaka Yamamoto, all of Niigata-ken; Akihisa Inoue, Miyagi-ken, all of (JP)

(73) Assignee: ALPS Electric Co., Ltd. (JP)

( * ) Notice: Subject to any disclaimer, the term of this patent is extended or adjusted under 35 U.S.C. 154(b) by 0 days.

(21) Appl. No.: 09/201,922

(22) Filed: Dec. 1, 1998

(30) Foreign Application Priority Data

Dec. 2, 1997 (JP) ..... 9-332134
Sep. 16, 1998 (JP) ..... 10-280557

(51) Int. Cl.[7] ..... H01F 1/057; H01F 1/058; H01F 1/053

(52) U.S. Cl. ..... 148/302; 148/301; 75/242; 75/244; 75/246; 75/247

(58) Field of Search ..... 148/301, 302, 148/303; 75/242, 244, 246, 247

(56) References Cited

U.S. PATENT DOCUMENTS 4,836,868 * 6/1989 Yajima et al. ..... 148/302
5,017,247 5/1991 Honkura et al. .
5,022,939 * 6/1991 Yajima et al. ..... 148/302
5,049,208 * 9/1991 Yajima et al. ..... 148/302
5,482,573 * 1/1996 Sakurada et al. ..... 148/301
5,976,273 * 11/1999 Takeuchi et al. ..... 148/302

FOREIGN PATENT DOCUMENTS 55-067110 5/1980 (JP) .
3-39451 2/1991 (JP) .

OTHER PUBLICATIONS

Manrakhan W. et al., "Melt–Spun SM (Cofecuzr) ZMX (M=B or C) Nonocomposite Magnets" IEEE Transactions On Magnetics, vol. 33, No. 5, part 02, Sep. 1997, pp. 3898–3900, XP000703251.

* cited by examiner

*Primary Examiner*—John Sheehan
(74) *Attorney, Agent, or Firm*—Brinks Holfer Gilson & Lione

(57) ABSTRACT

A hard magnetic material contains Co as a main component, at least one element Q of P, C, Si and B, and Sm, and an amorphous phase and a fine crystalline phase. The texture of the hard magnetic material contains 50% by volume or more of fine crystalline phase having an average crystal grain size of 100 nm or less, and has a mixed phase state containing a soft magnetic phase and a hard magnetic phase. Further, anisotropy is imparted to the crystal axis of the hard magnetic phase.

28 Claims, 33 Drawing Sheets

(2 of 33 Drawing Sheet(s) Filed in Color)

HARD MAGNETIC MATERIAL

BACKGROUND OF THE INVENTION

1. Field of the Invention

The present invention relates to a hard magnetic material having excellent hard magnetic characteristics.

2. Description of the Related Art

Materials generally known as hard magnetic materials having performance superior to ferrite magnets and alnico magnets (Al—Ni—Co—Fe system magnets) include a Sm—Co system magnet, a Nd—Fe—B system magnet, and the like.

The Nd—Fe—B system magnet is a magnet having high coercive force (iHc), remanent magnetization, and maximum magnetic energy product ($(BH)_{max}$), and excellent hard magnetic characteristics, but has a problem in that since its magnetic characteristics greatly vary with temperature, it cannot be used as a constituent material for a sensor or the like, which is used at high temperatures.

The Sm—Co system magnet causes less changes in magnetic characteristics with temperature, but has a problem in that since coercive force (iHc) is lower than that of the Nd—Fe—B system magnet, hard magnetic characteristics deteriorate, particularly when it is used for a small device such as a motor, an actuator, or the like.

SUMMARY OF THE INVENTION

The present invention has been achieved for solving the above problems, and it is an object of the present invention to provide a hard magnetic material having excellent hard magnetic characteristics, particularly high coercive force (iHc).

In order to achieve the above object, the present invention utilizes the following construction.

A hard magnetic material of the present invention comprises Co as a main component, at least one element Q of P, C, Si, and B, and Sm, and has an amorphous phase and a fine crystalline phase.

A hard magnetic material of the present invention comprises Co as a main component, at least one element Q of P, C, Si and B, Sm, and at least one type element of at least one element M of Nb, Zr, Ta, and Hf, at least one element R of Sc, Y, La, Ce, Pr, Nd, Pm, Eu, Gd, Tb, Dy, Ho, Er, Tm, Yb, and Lu, and at least one element X of Al, Ge, Ga, Cu, Ag, Pt, and Au, and has an amorphous phase and a fine crystalline phase.

The hard magnetic material of the present invention comprises a bulk formed by heating an alloy powder having the above-described composition and then solidifying the alloy.

The bulk is preferably formed by solidification utilizing a softening phsenomenon which occurs in crystallization reaction of the amorphous phase.

In the hard magnetic material of the present invention, the texture has at least 50% by volume of fine crystalline phase having an average crystal grain size of 100 nm or less.

In the hard magnetic material of the present invention, a mixed phase state containing a soft magnetic phase and a hard magnetic phase is formed in the texture.

In the hard magnetic materials of the present invention, the soft magnetic phase contains at least one of a bcc-Fe phase, a bcc-(FeCo) phase, a $D_{20}E_3Q$ phase containing dissolved atoms and the residual amorphous phase, and the hard magnetic phase contains at least a $E_2D_{17}$ phase containing dissolved atoms.

D is at least one element of transition metals, and is preferably either or both of Co and Fe. E is an element at least one element of Sm, Sc, Y, La, Ce, Pr, Nd, Pm, Eu, Gd, Tb, Dy, Ho, Er, Tm, Yb, and Lu, and Q is at least one element of P, C, Si, and B.

In the hard magnetic material of the present invention, the crystal axis of the hard magnetic phase is oriented to impart magnetic anisotropy.

In the hard magnetic material of the present invention, the ratio Ir/Is of remanent magnetization Ir to saturation magnetization Is is 0.6 or more.

The hard magnetic material of the present invention is represented by the following composition formula:

$$(Co_{1-f}T_f)_{100-x-y-z-t}M_xSm_yR_zQ_t$$

wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu other than Sm, Q is at least one element of P, C, Si, and B, $0 \leqq f < 0.5$, 0 atomic $\% \leqq x$ 4$\leqq$atomic %, 8 atomic $\% \leqq y \leqq 16$ atomic %, 0 atomic $\% \leqq z$ 5 atomic %, 0.5 atomic $\% \leqq t \leqq 10$ atomic %, and 8 atomic $\% \leqq x+y+z \leqq 16$ atomic %.

The hard magnetic material of the present invention is represented by the following composition formula:

$$(Co_{1-f}T_f)_{100-x-y-z-t-u}M_xSm_yR_zQ_tX_u$$

wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu other than Sm, Q is at least one element of P, C, Si, and B, X is at least one element of Al, Ge, Ga, Cu, Ag, Pt, and Au, $0 \leqq f < 0.5$, 0 atomic $\% \leqq x4 \leqq$atomic %, 8 atomic $\% \leqq y \leqq 16$ atomic %, 0 atomic $\% \leqq z \leqq 5$ atomic %, 0.5 atomic $\% \leqq t \leqq 10$ atomic %, 0 atomic $\% \leqq u \leqq 5$ atomic %, and 8 atomic $\% \leqq x+y+z \leqq 16$ atomic %.

In the hard magnetic material of the present invention, the composition ratio f is in the range of $0.2 \leqq f < 0.5$.

The hard magnetic material of the present invention preferably necessarily contains Nb.

The composition ratio x is preferably in the range of 1 atomic $\% \leqq x \leqq 3$ atomic %.

The composition ratio y preferably is in the range of 10 atomic $\% \leqq y \leqq 13$ atomic %.

The composition ratio z is preferably in the range of 2 atomic $\% \leqq z \leqq 5$ atomic %.

The composition ratio t is preferably in the range of 3 atomic $\% \leqq t \leqq 8$ atomic %.

The composition ratio u is preferably in the range of 1 atomic $\% \leqq u \leqq 3$ atomic %.

The composition ratio (x+y+z) is preferably in the range of 10 atomic $\% \leqq x+y+z \leqq 13$ atomic %.

BRIEF DESCRIPTION OF THE DRAWINGS

The file of this patent contains at least two sheets of drawings executed in color. Copies of this patent with color drawings will be provided by the Patent and Trademark Office upon request and payment of the necessary fee.

FIG. 17 is a drawing illustrating the direction of application of sintering pressure in production of a bulk, in which FIG. 7B is a perspective view showing a bulk having a size of 1×2×4 mm;

DESCRIPTION OF THE PREFERRED EMBODIMENTS

Figure 1:
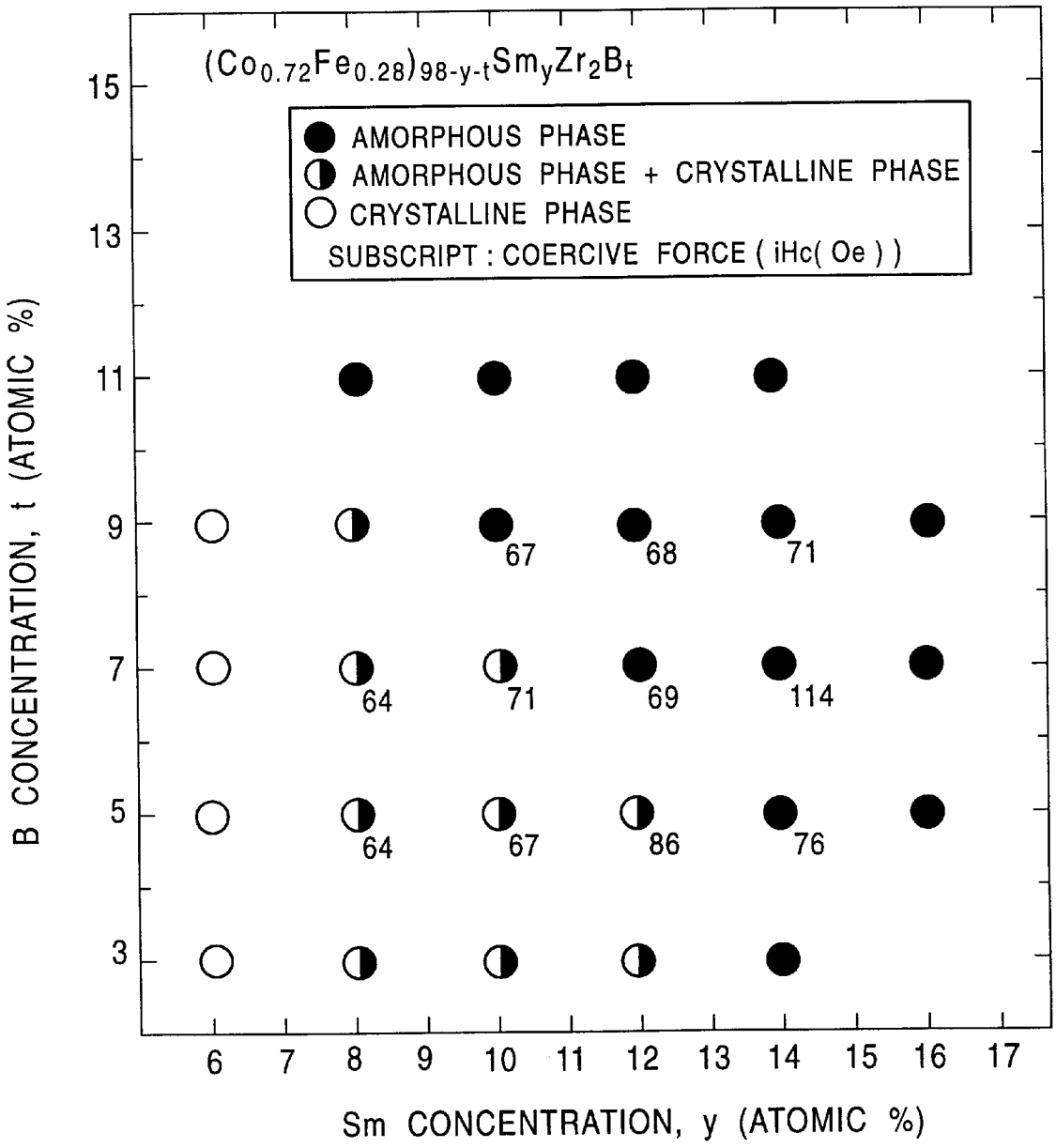
FIG. 1 is a graph showing the texture states and coercive force (iHc) of quenched ribbons having the composition $(Co_{0.72}Fe_{0.28})_{98-y-t}Sm_yZr_2B_t$ (wherein y=6, 8, 10, 12, 14 and 16, t=3, 5, 7, 9 and 11)

Embodiments of the present invention will be described below with reference to the drawings.

A hard magnetic material of the present invention comprises Co as a main component, at least one element Q of P, C, Si and B, and Sm. and has an amorphous phase and a fine crystalline phase.

A hard magnetic material of the present invention comprises Co as a main component, at least one element Q of P, C, Si and B, Sm, and at least one type of element of at least one element M of Nb, Zr, Ta, and Hf, at least one element R of Sc, Y, La, Ce, Pr, Nd, Pm, Eu, Gd, Tb, Dy, Ho, Er, Tm, Yb and Lu, and at least one element X of Al, Ge, Ga, Cu, Ag, Pt and Au, and has an amorphous phase and a fine crystalline phase.

In the hard magnetic material having an amorphous phase and a fine crystalline phase, the texture contains 50% by volume or more of the fine crystalline phase having an average crystal grain size of 100 nm or less. In the fine crystalline phase are precipitated a soft magnetic phase comprising at least one of a bcc-Fe phase, a bcc-(FeCo) phase and a $D_{20}E_3Q$ phase containing dissolved atoms and having an average grain size of 100 nm or less, and a hard magnetic phase comprising a $E_2D_{17}$ phase containing dissolved atoms and having an average grain size of 100 nm or less. Here, D is at least one transition element, and particularly preferably either or both of Fe and Co. E is at least one element of Sm, Sc, Y, La, Ce, Pr, Nd, Pm, Eu, Gd, Tb, Dy, Ho, Er, Tm, Yb and Lu, and Q is at least one element of P, C, Si and B, as described above.

The residual amorphous phase comprises a soft magnetic phase similar to the bcc-Fe phase or the like.

Furthermore, the hard magnetic material has a nanocomposite phase texture comprising the fine crystalline phase and the residual amorphous phase.

In the hard magnetic material of the present invention, a mixed phase state comprising the soft magnetic phase and the hard magnetic phase is formed in the texture thereof.

In the hard magnetic material of the present invention, the easy magnetization axis as the crystal axis of the hard magnetic phase is oriented to impart magnetic anisotropy.

Also the hard magnetic material of the present invention has a bulk shape formed by heating an alloy powder having the above composition and then solidifying the alloy.

Furthermore, the hard magnetic material of the present invention is a bulk preferably formed by heating, solidification and then heat treatment to precipitate the fine crystalline phase.

The bulk is preferably formed by solidification using a softening phenomenon which occurs in crystallization reaction of the amorphous phase.

Specifically, the bulk of the hard magnetic material is produced by first preparing an alloy power (powder and granular material) comprising an amorphous phase as a main phase. The alloy powder can be obtained by a process comprising quenching an alloy melt to obtain a ribbon or power, and then grinding the ribbon obtained to form a powder. The thus-obtained alloy powder has a grain size of about 37 $\mu$m to about 100 $\mu$m.

Methods used as the method of obtaining the alloy comprising the amorphous phase as a main phase from the alloy melt include a method of quenching a melt by spraying it on a rotating drum to form a ribbon, a method of quenching a melt in a droplet state by injecting the melt in a cooling gas to form a powder, a method of sputtering or CVD, and the like; the alloy used in the present invention and comprising the amorphous phase as a main phase may be produced by any one of these methods.

The alloy ribbon or alloy powder obtained by quenching has a texture comprising the amorphous phase.

The thus-obtained alloy powder is then subjected to crystallization of the amorphous phase thereof or grain growth of the fine crystalline phase under stress, and simultaneous or successive consolidation to form a mixed phase state comprising the soft magnetic phase and the hard magnetic phase in the texture in which the fine crystalline phase having an average crystal grain size of 100 nm or less is precipitated, or to precipitate the fine crystalline phase having an average crystal grain size of 100 nm or less in the texture comprising the amorphous phase and form the mixed phase state. At the same time, the easy magnetization axis of the hard magnetic phase is oriented to impart magnetic anisotropy.

By imparting magnetic anisotropy, remanent magnetization (Ir) and maximum energy product $((BH)_{max})$ in the use in the direction of easy magnetization axis is higher than an isotropic material.

In crystallization or grain growth under stress, the alloy power is preferably heated to the crystallization temperature or higher, with the pressure applied in one direction.

In consolidation, the alloy powder is preferably solidified by using a softening phenomenon which occurs in crystallization reaction. The reason for solidifying the alloy powder by using a softening phenomenon which occurs in crystallization reaction of the alloy comprising the amorphous phase as a main phase is that when the amorphous phase of the alloy comprising the amorphous phase as a main phase is heated to the crystallization temperature or a pre-stage thereof, a softening phenomenon significantly occurs, and the power particles of the amorphous alloy are contact-bonded and integrated under pressure, thereby obtaining a high-density bulk of the hard magnetic material by solidification of the softened amorphous alloy.

In solidification by consolidation, an alloy containing at least 50% by weight of the amorphous phase is used as the alloy powder because the alloy power particles are strongly bonded to obtain a permanent magnet having high hard magnetic characteristics.

In heating, the heating rate is 3 K/min or more, preferably 10 K/min or more. At a heating rate of less than 3 K/min, crystal grains are coarsened, and thus exchange coupling force is weakened, thereby deteriorating hard magnetic characteristics. Thus, this heating rate is undesirable.

The heating temperature is 400° C. to 800° C., preferably 500° C. to 650° C. With a heating temperature of less than 400° C., a high-density hard magnetic material cannot be obtained because the temperature is too low, and this temperature is thus undesirable. A heating temperature over 800° C. causes grain growth of the crystal grains of the fine crystal phase and thus causes deterioration in hard magnetic characteristics. This temperature is thus undesirable.

As the above-described method of solidifying the alloy powder, for example, a spark plasma sintering method, a hot press method, or the like can be used.

In the hard magnetic material of the present invention, after crystallization or grain growth of the alloy powder under stress, heat treatment is performed in a temperature range of 400 to 900° C., preferably 600 to 800° C., at the same time or after consolidation, to precipitate, as a main phase, a fine crystalline phase having an average crystal grain size of 100 nm or less in the texture. As a result, hard magnetic characteristics are manifested. A heat treatment temperature (annealing temperature) of less than 400° C. is undesirable because sufficient hard magnetic characteristics cannot be obtained due to precipitation of a small amount of $E_2C_{17}$ phase which has hard magnetic characteristics. On the other hand, a heat treatment temperature of over 900° C. is undesirable because hard magnetic characteristics deteriorate due to the grain growth of crystal grains of the fine crystalline phase.

Furthermore, the heat treatment time is 0 to 15 minutes, preferably 0 to 5 minutes. With a heat treatment time of over 15 minutes, the crystal grains of the fine crystalline phase grow, thereby undesirably deteriorating the hard magnetic characteristics.

Conditions for heat treatment are selected so that the texture contains 50% by volumes or more of fine crystalline phase having an average crystal grain size of 100 nm or less, and the residue comprises the amorphous phase. In addition, in the fine crystalline phase are formed a soft magnetic phase comprising at least one of a bcc-Fe phase, a bcc-(FeCo) phase, a $D_{20}E_3Q$ phase and the residual amorphous phase, and a hard magnetic phase comprising at least a $E_2D_{17}$ phase, to obtain a hard magnetic material having extremely high hard magnetic characteristics.

In the hard magnetic material obtained by the above-described method, the remanence ratio (Ir/Is) of remanent magnetization (Ir) to saturation magnetization (Is) is preferably 0.6 or more because a strong permanent magnet can be formed. The hard magnetic material is produced by subjecting an alloy powder comprising the amorphous phase as a main phase to crystallization or grain growth under stress to orient the easy magnetization axis of the hard magnetic phase, thereby imparting magnetic anisotropy to the alloy. This increases remanent magnetization (Ir) and maximum energy product ($(BH)_{max}$).

Furthermore, the bulk of the hard magnetic material is formed by pressure bonding and integration of the amorphous alloy powder under pressure to form a permanent magnet which is physically hard and small, and has high hard magnetism, as compared with a conventional bonded magnet formed by bonding a magnetic power with a binder. The bulk comprising the hard magnetic material of the present invention is formed from a powder, as described above, and thus it can be formed in various shapes.

Therefore, the hard magnetic material of the present invention is useful as a permanent magnet used for various devices such as a motor, an actuator, a rotary encoder, a magnetic sensor, a speaker, and the like.

The hard magnetic material of the present invention has a composition represented by the following formula:

$$(Co_{1-f}T_f)_{100-x-y-z-t}M_xSm_yR_zQ_t$$

(wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu, Q is at least one element of P, C, Si, and B, $0 \leqq f < 0.5$, 0 atomic $\% \leqq x$ 4≦atomic %, 8 atomic $\% \leqq y \leqq 16$ atomic %, 0 atomic $\% \leqq z \leqq 5$ atomic %, 0.5 atomic $\% \leqq t \leqq 10$ atomic %, and 8 atomic $\% \leqq x+y+z \leqq 16$ atomic %).

Co is an element which provides hard magnetic characteristics, and is essential for the hard magnetic material of the present invention. The amorphous phase containing element D including Co, and element E is subjected to heat treatment at an appropriate temperature in the range of 400 to 900° C., to precipitate the hard magnetic phase comprising a $E_2D_{17}$ phase, and the soft magnetic phase comprising at least one of a bcc-Fe phase, a bcc-(FeCo) phase, a $D_{20}E_3Q$ phase and the residual amorphous phase.

In the above formula, T represents at least one element of Fe and Ni. The element T has the effect of increasing remanent magnetization (Ir), but an increase in concentration of the element T by substituting by Co deteriorates coercive force (iHc) due to a decrease in Co concentration. Therefore, particularly if a hard magnetic material having high saturation magnetization (Is) is required, element T is added, while if a hard magnetic material having high coercive force (iHc) is required, element T is not added. This permits production of the hard magnetic material having optimum hard magnetic characteristics according to application of the hard magnetic. material. By substituting expensive Co by inexpensive Fe or Ni, the production cost of the hard magnetic material can be decreased.

The composition ratio f of element T is preferably 0 to 0.5, more preferably 0.2 to 0.5, for exhibiting excellent hard magnetic characteristics.

Like Co, Sm provides hard magnetic characteristics and an essential element for the hard magnetic material of the present invention. Sm is also an element which easily forms an amorphous phase. The amorphous phase containing Co (element D) and Sm (element E) is subjected to heat treatment at an appropriate temperature in the range of 400 to 900° C. to precipitate the hard magnetic phase comprising a $(Fe, Co)_{17}Sm_2$ phase, and the soft magnetic phase comprising a bcc-Fe phase, a bcc-(FeCo) phase, or a $D_{20}E_3Q$ phase containing dissolved atoms. The residual amorphous phase also acts as the soft magnetic phase. The composition ratio y (atomic %) of Sm is preferably 8 atomic % to 16 atomic C, more preferably 10 atomic % to 13 atomic %. With a composition ratio y of less than 8 atomic %, coercive force (iHc) deteriorates due to a decrease in the amount of the hard magnetic phase precipitated, and the amount of the amorphous phase precipitated is not sufficient. With a composition ratio y of over 16 atomic %, the concentrations of Co and element T are decreased, and saturation magnetization (Is) is decreased accompanied with a decrease in remanent magnetization (Ir). Thus this composition ratio y is undesirable.

In the above formula, R represents at least one rare earth element of Sc, Y, La, Ce, Pr, Nd, Pm, Eu, Gd, Tb, Dy, Ho, Er, Tm, Yb and Lu other than Sm. The element R is an element which easily forms an amorphous phase.

In order to sufficiently form 50% by weight or more of amorphous phase in the alloy, form a sufficient amount of fine crystalline phase by crystallizing the amorphous phase, and realize good hard magnetic characteristics, the composition ratio z of the element R must be 1 atomic % or more, preferably 2 atomic % or more.

On the other hand, as the composition ratio z of the element R increases, the saturation magnetization (Is) of the obtained hard magnetic material tends to decrease. In order to obtain high remanent magnetization (Ir), the composition ratio z of the element R must be 5 atomic % or less. When the element R partially or entirely comprises Nd and/or Pr, higher hard magnetic characteristics are obtained.

The element R can be replaced by Sm to form a $D_{17}E_2$ phase, which can exhibit hard magnetic characteristics.

In the above formula, M represents at least one element of Nb, Zr, Ta and Hf. The element M has the high ability to form an amorphous phase, and addition of the element M permits sufficient formation of the amorphous phase even if the composition ratio of the expensive element R (rare earth element) is decreased. However, by substituting the element M by Co and element T to increase the composition ratio x (atomic %), the saturation magnetization (Is) of the obtained hard magnetic material is decreased. A decrease in the composition ratio x of the element M makes impossible the sufficient formation of the amorphous phase. From this viewpoint, the composition ratio x of the lement M is preferably 0 to 4 atomic C, more preferably 2 atomic % to 4 atomic %.

Of these elements M, Nb is particularly effective. By partially or entirely substituting the element M by Nb, the coercive force (iHc) of the hard magnetic material is increased.

Sm, element R and element M have the common property of easily forming the amorphous phase. The total (x+y+z) of the composition ratios of these elements is preferably 8 atomic % to 16 atomic %, more preferably 10 atomic % to 13 atomic %. With a total composition ratio (x+y+z) of less than 8 atomic %, precipitation of the amorphous phase is undesirably insufficient. With a total composition ratio (x+y+z) of over 16 atomic %, hard magnetic characteristics undesirably deteriorate.

In the above formula, Q represents at least one element of P, C, Si and B, which easily form an amorphous phase. The amorphous phase containing element D including Co, element Q including B and element E including Sm is subjected to heat treatment at an appropriate temperature in the range of 400 to 900° C. to precipitate the soft magnetic phase comprising the $D_{20}E_3Q$ phase. In order to form a sufficient amount of amorphous phase in the alloy, and obtain a sufficient amount of fine crystalline phase by crystallizing the amorphous phase, the composition ratio t of element Q must be 0.5 atomic % or more, preferably 3 atomic % or more. However, an excessive increase in the composition ratio t (atomic %) of element Q causes the tendency that the saturation magnetization (Is), remanent magnetization (Ir) and coercive force (iHc) of the obtained hard magnetic material decrease. In order to obtain good hard magnetic characteristics, therefore, the composition ratio t of element Q must be 10 atomic % or less, preferably 9 atomic % or less.

The hard magnetic material of the present invention may contain at least one element X of Al, Ge, Ga, Cu, Ag, Pt and Au. In this case, the hard magnetic material can be represented by the following composition formula:

$$(Co_{1-f}T_f)_{100-x-y-z-t-u}M_xSm_yR_zQ_tX_u$$

(wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu, Q is at least one element of P, C, Si, and B, X is at least one element of Al, Ge, Ga, Cu, Ag, Pt and Au, $0 \leqq f < 0.5$, 0 atomic $\% \leqq x \leqq 4$ atomic %, 8 atomic $\% \leqq y \leqq 16$ atomic %, 0 atomic $\% \leqq z \leqq 5$ atomic %, 0.5 atomic $\% \leqq t \leqq 10$ atomic %, 0 atomic $\% \leqq u \leqq 5$ atomic %, and 8 atomic $\% \leqq x+y+z \leqq 16$ atomic %).

In this case, the composition ratio f of element T is preferably 0 to 0.5, more preferably 0.2 to 0.5, in order to exhibit excellent hard magnetic characteristics.

In the above composition formula, the composition ratio y (atomic %) of Sm is preferably 8 atomic % ot 16 atomic %, more preferably 10 atomic % to 13 atomic %, in order to obtain good hard magnetic characteristics.

In the above composition formula, the composition ratio z (atomic %) of element R must be 0 atomic % or more, more preferably 2 atomic % or more, in order to impart excellent hard magnetic characteristics and obtain a good amorphous phase and fine crystalline phase.

On the other hand, as the composition ratio z of element R increases, the saturation magnetization (Is) of the obtained hard magnetic material decreases. Therefore, in order to obtain high remanent magnetization (Ir), the composition ratio z of element R must be 5 atomic % or more.

In the above composition formula, the composition ratio x (atomic %) of element M is preferably 0 to 4 atomic %, more preferably 1 atomic % to 3 atomic %, in order to obtain good hard magnetic characteristics.

Of the elements M, Nb is particularly effective. By partially or entirely substituting element M by Nb, the coercive force (iHc) of the hard magnetic material is increased.

Sm and the elements R and M have the common property of easily forming an amorphous phase, and the total (x+y+z) of the composition ratios of these elements is preferably 8 atomic % to 16 atomic %, more preferably 10 atomic % to 14 atomic %. With a total composition ratio (x+y+z) of less than 8 atomic %, precipitation of the amorphous phase is undesirably insufficient. With a total composition ratio (x+y+z) of over 16 atomic %, hard magnetic characteristics undesirably deteriorate.

In the composition formula, the composition ratio t (atomic %) of element Q must be 0.5 atomic % or more, preferably 3 atomic % or more, in order to obtain a good amorphous phase and fine crystalline phase. The composition ratio t of element Q must be 10 atomic % or less, preferably 9 atomic % or less, in order to obtain good hard magnetic characteristics.

In the above formula, element X is at least one element of Al, Ge, ga, Cu, Ag, Pt and Au, which mainly improve the corrosion resistance of the hard magnetic material.

Of these elements X, Cu, Ag, Pt and Au are insoluble in Fe, and thus have the effect of promoting micronization of crystal grains in precipitation of the fine crystalline phase by heat treatment.

Of these elements X, Ge, Ga and Al have the effect of promoting the formation of a nano-composite phase texture in a mixed phase state comprising the fine crystalline phase and the amorphous phase.

The composition ratio u (atomic %) of element X is preferably 0 to 5 atomic %, more preferably 1 atomic % to 3 atomic %. With a composition ratio u of over 5 atomic %, the amorphous phase forming ability deteriorates, and hard magnetic characteristics also undesirably deteriorate.

The hard magnetic material contains Co as a main component, at least one element Q of P, C, Si and B, and Sm, and has the amorphous phase and the fine crystalline phase to form a nano-composite phase texture comprising the fine crystalline phase and the amorphous phase, and thus excellent hard magnetic characteristics can be exhibited.

In the hard magnetic material having the above composition and further containing at least one type of element of at least one element M of Nb, Zr, Ta and Hf, at least one element R of Sc, Y, La, Ce, Pr, Nd, Pm, Eu, Gd, Tb, Dy, Ho, Er, Tm, Yb and Lu, and at least one element X of Al, Ge, Ga, Cu, Ag, Pt and Au, the amorphous phase forming ability can be further increased, and thus the hard magnetic characteristics can be further improved.

The hard magnetic material is produced by heating an alloy powder having the above composition and then solidifying the alloy to precipitate the fine crystalline phase, and preferably the bulk is formed by solidification using a softening phenomenon which occurs in crystallization reaction. Therefore, the hard magnetic material exhibits excellent hard magnetic characteristics and can be easily formed in various shapes.

In the hard magnetic material, the texture contains 50% by volume or more of fine crystalline phase having an average crystal grain size of 100 nm or less, and the mixed phase state comprising the soft magnetic phase and the hard magnetic phase is formed in the texture, thereby exhibiting high hard magnetic characteristics. Also the hard magnetic material can be provided with characteristics of the soft magnetic phase and the hard magnetic phase.

Since the easy magnetization axis of the hard magnetic phase is oriented to impart magnetic anisotropy, remanent magnetization (Ir) can be increased.

In the hard magnetic material, the ratio Ir/Is of remanent magnetization Ir to saturation magnetization Is is 0.6 or more, and thus the maximum energy product ($(BH)_{max}$) can be increased.

Since the hard magnetic material is represented by the following composition formula, an alloy comprising the amorphous phase as a main phase can easily be obtained by quenching an alloy melt, and the fine crystalline phase can be precipitated by heat treatment of the alloy, thereby exhibiting excellent hard magnetic characteristics.

$$(Co_{1-f}T_f)_{100-x-y-z-t}M_xSm_yR_zQ_t$$

(wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu, Q is at least one element of P, C, Si, and B, $0 \leqq f < 0.5$, 0 atomic $\% \leqq x < 4$ atomic %, 8 atomic $\% \leqq y \leqq 16$ atomic %, 0 atomic $\% \leqq z \leqq 5$ atomic %, 0.5 atomic $\% \leqq t \leqq 10$ atomic %, and 8 atomic $\% \leqq x+y+z \leqq 16$ atomic %); or $$(Co_{1-f}T_f)_{100-x-y-z-t-u}M_xSm_yR_zQ_tX_u$$

(wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu, Q is at least one element of P, C, Si, and B, X is at least one element of Al, Ge, Ga, Cu, Ag, Pt and Au, $0 \leqq f < 0.5$, 0 atomic $\% \leqq x \leqq 4$ atomic %, 8 atomic $\% \leqq y \leqq 16$ atomic %, 0 atomic $\% \leqq z \leqq 5$ atomic %, 0.5 atomic $\% \leqq t \leqq 10$ atomic %, 0 atomic $\% \leqq u \leqq 5$ atomic %, and 8 atomic $\% \leqq x+y+z \leqq 16$ atomic %).

In the above composition formula, with composition ratio f in the range of $0.2 \leqq f < 0.5$, the hard magnetic characteristics can be further improved.

Furthermore, addition of Nb to the hard magnetic material can increase the coercive force (iHc) of the hard magnetic material.

EXAMPLES

Example 1

Predetermined amounts of Co, Fe, Sm, Zr and B as raw materials were weighed, and melted in a high-frequency induction heating apparatus or an arc discharge heating apparatus in an Ar atmosphere under reduced pressure to form an ingot having a predetermined composition. The ingot was placed and melted in a crucible, and then quenched by a single roll method in which a melt was sprayed on a rotating roll from a nozzle to obtain a quenched ribbon having the composition $(Co_{0.72}Fe_{0.28})_{98-y-t}Sm_yZr_2B_t$ (wherein y=6, 8, 10, 12, 14 and 16, t=3, 5, 7, 9 and 11).

A quenched ribbon having the composition $(Co_{0.72}Fe_{0.28})_{98-y-t}Sm_yNb_2B_t$ (wherein y=8, 10, 12, 14 and 16, t=3, 5, 7 and 9) was obtained by a similar method.

Each of the thus-obtained quenched ribbons was examined with respect to the texture state thereof by X-ray diffraction analysis. Furthermore, each of the ribbons was measured with respect to coercive force (iHc) at room temperature in the applied magnetic field of 1.5 T or a vacuum by using VSM (Vibrating Sample Magnetometer). The results are shown in FIGS. 1 and 2.

Figure 2:
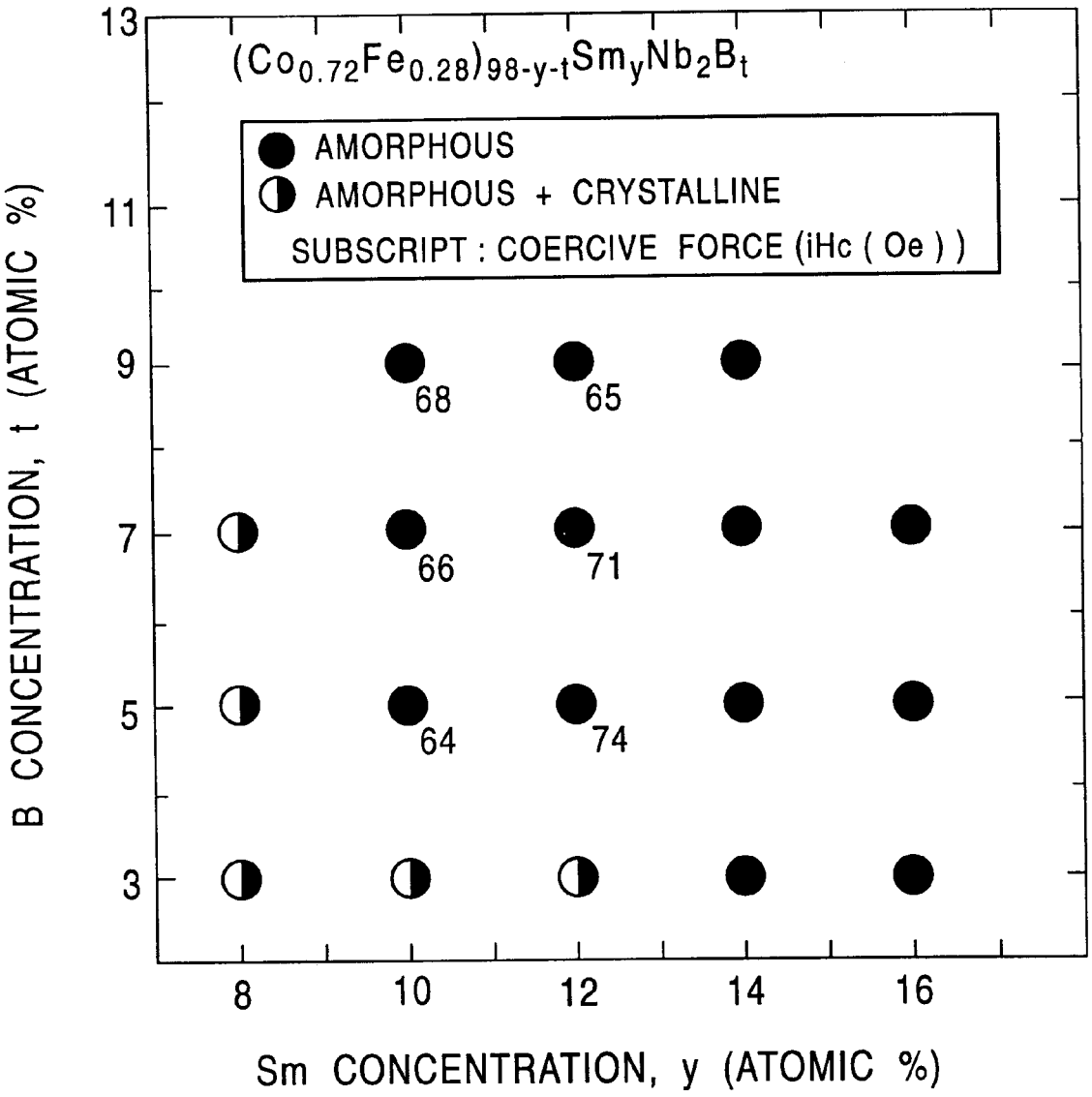
FIG. 2 is a graph showing the texture states and coercive force (iHc) of quenched ribbons having the composition $(Co_{0.72}Fe_{0.28})_{98-y-t}Sm_yNb_2B_t$ (wherein y=8, 10, 12, 14 and 16, t=3, 5, 7 and 9)

FIG. 1 shows that in the quenched ribbon having the composition $(Co_{0.72}Fe_{0.28})_{98-y-t}Sm_yZr_2B_t$, almost all textures comprise an amorphous phase under conditions of y=8 atomic % or more and t=11 atomic % or more, or Y=14 atomic % or more and t=3 atomic % or more, and the texture is a crystalline phase at y=6 atomic % and 3 atomic % t 9 atomic %; a mixed state comprising an amorphous phase and a crystalline phase is formed under other conditions.

It is thus found that in the quenched ribbon having the composition $(Co_{0.72}Fe_{0.28})_{98-y-t}Sm_yZr_2B_t$, the Sm concentration of the alloy must be 8 atomic % or more in order to obtain a quenched ribbon comprising the amorphous phase as a main phase by quenching the alloy melt.

Therefore, in the case of M=Zr, at a Sm concentration of 8 atomic % or more, the uniform and fine crystalline phase can be precipitated after heat treatment.

It is further found that all ribbons have coercive force (iHc) of about 64 to 114 Oe, and a quenched ribbon not subjected to heat treatment has low coercive force (iHc).

FIG. 2 shows that in the quenched ribbon having the composition $(Co_{0.72}Fe_{0.28})_{98-y-t}Sm_yNb_2B_t$, almost all textures comprise an amorphous phase under conditions of y=10 atomic % or more and t=5 atomic % or more, or Y=14 atomic % or more and t=3 atomic % or more; a mixed state comprising the amorphous phase and the crystalline phase is formed under other conditions.

It is thus found that in the quenched ribbon having the composition $(Co_{0.72}Fe_{0.28})_{98-y-t}Sm_yNb_2B_t$, the Sm concentration of the alloy must be 10 atomic % or more in order to obtain a quenched ribbon comprising the amorphous phase as a main phase by quenching the alloy melt.

Therefore, in the case of M=Nb, at a Sm concentration of 10 atomic % or more, the uniform and fine crystalline phase can be precipitated after heat treatment.

It is further found that all ribbons have coercive force (ihc) of about 64 to 74 Oe, and a quenched ribbon not subjected to heat treatment has low coercive force (iHc).

Example 2

The same method as Example 1 was repeated to obtain a quenched ribbon having each of the compositions $(Co_{0.72}Fe_{0.28})_{83}Sm_{10}Nb_2B_5$, $(Co_{0.72}Fe_{0.28})_{81}Sm_{10}Nb_2B_7$, $(Co_{0.72}Fe_{0.28})_{79}Sm_{10}Nb_2B_9$, $(Co_{0.72}Fe_{0.28})_{83}Sm_{10}Zr_2B_5$, $(Co_{0.72}Fe_{0.28})_{81}Sm_{10}Zr_2B_7$, $(Co_{0.72}Fe_{0.28})_{79}Sm_{10}Zr_2B_9$, $(Co_{0.72}Fe_{0.28})_{81}Sm_{12}Nb_2B_5$, $(CO_{0.72}Fe_{0.28})_{79}Sm_{12}Nb_2B_7$, $(Co_{0.72}Fe_{0.28})_{77}Sm_{12}Nb_2B_9$, $(Co_{0.72}Fe_{0.28})_{81}Sm_{12}Zr_2B_5$, $(Co_{0.72}Fe_{0.28})_{79}Sm_{12}Zr_2B_7$, $(Co_{0.72}Fe_{0.28})_{77}Sm_{12}Zr_2B_9$, $(Co_{0.72}Fe_{0.28})_{85}Sm_8Zr_2B_5$, $(Co_{0.72}Fe_{28})_{83}Sm_8Zr_2B_7$, $(Co_{0.72}Fe_{0.28})_{79}Sm_{14}Zr_2B_5$, $(Co_{0.72}Fe_{0.28})_{77}Sm_{14}Zr_2B_7$, $(Co_{0.72}Fe_{0.28})_{75}Sm_{14}Zr_2B_9$, $(Co_{0.72}Fe_{0.28})_{79}Sm_{12}Nb_2B_7$, $(Co_{0.86}Fe_{0.34})_{70}Sm_{12}Nb_2B_7$, $(Co_{0.60}Fe_{0.40})_{79}Sm_{12}Nb_2B_7$, $(Co_{0.72}Fe_{0.28})_{81}Sm_{12}B_7$, $(Co_{0.72}Fe_{0.28})_{79}Sm_{12}Nb_2B_7$, $(Co_{0.72}Fe_{0.28})_{77}Sm_{12}Nb_4B_7$, $(Co_{0.72}Fe_{0.28})_{81}Sm_{12}Nb_2B_5$, $(Co_{0.66}Fe_{0.34})_{81}Sm_{12}Nb_2B_5$, $(Co_{0.60}Fe_{0.40})_{81}Sm_{12}Nb_2B_5$, $(Co_{0.72}Fe_{0.28})_{83}Sm_{12}B_5$, $(Co_{0.72}Fe_{0.28})_{81}Sm_{12}Nb_2B_5$, and $(Co_{0.72}Fe_{28})_{79}Sm_{12}Nb_4B_5$, Each of the thus-obtained quenched ribbons was subjected to heat treatment by heating to 873 K (600° C.) to 1173 K (900° C.) at a heating rate of 3 K/min in an infrared image furnace at $5\times10^{-5}$ Pa or less, and then holding for about 3 minutes, to obtain a ribbon sample in which a fine crystalline phase was precipitated.

The thus-obtained ribbon samples were measured with respect to magnetization ($I_{1.5}$) in the applied magnetic field of 1.5 T or a vacuum, remanet magnetization (Ir), remanence ratio ($Ir/I_{1.5}$). and coercive force (iHc) by using VSM (vibrating sample magnetometer). The results shown in FIGS. 3 to 12.

Figure 3:
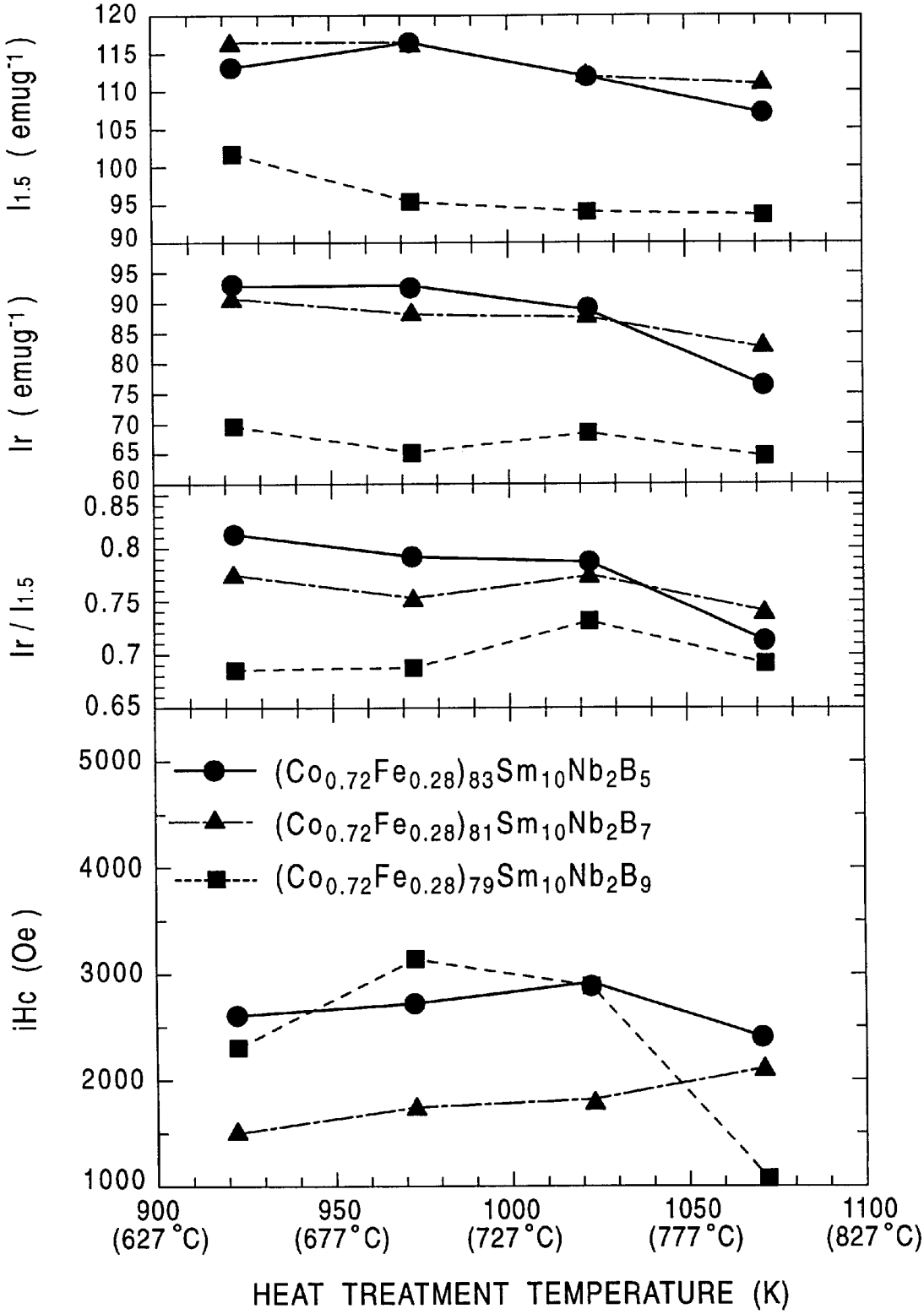
FIG. 3 is a graph showing the dependence of magnetization ($I_{1.5}$), remanent magnetization (Ir), remanence ratio ($Ir/I_{1.5}$) and coercive force (iHc) on heat treatment temperature of a quenched ribbon having each of the compositions $(Co_{0.72}Fe_{0.28})_{83}Sm_{10}Nb_2B_5$, $(Co_{0.72}Fe_{0.28})_{81}Sm_{10}Nb_2B_7$ and $(Co_{0.72}Fe_{0.28})_{79}Sm_{10}Nb_2B_9$.

FIG. 3 indicates that in the ribbon samples having the composition $(Co_{0.72}Fe_{0.28})_{88-t}Sm_{10}Nb_2B_t$ (t=5, 7 and 9), hard magnetic characteristics little change in the heat treatment temperature range of 923 K (650° C.) to 1073 K (800° C.), without the dependency on the heat treatment temperature.

Figure 4:
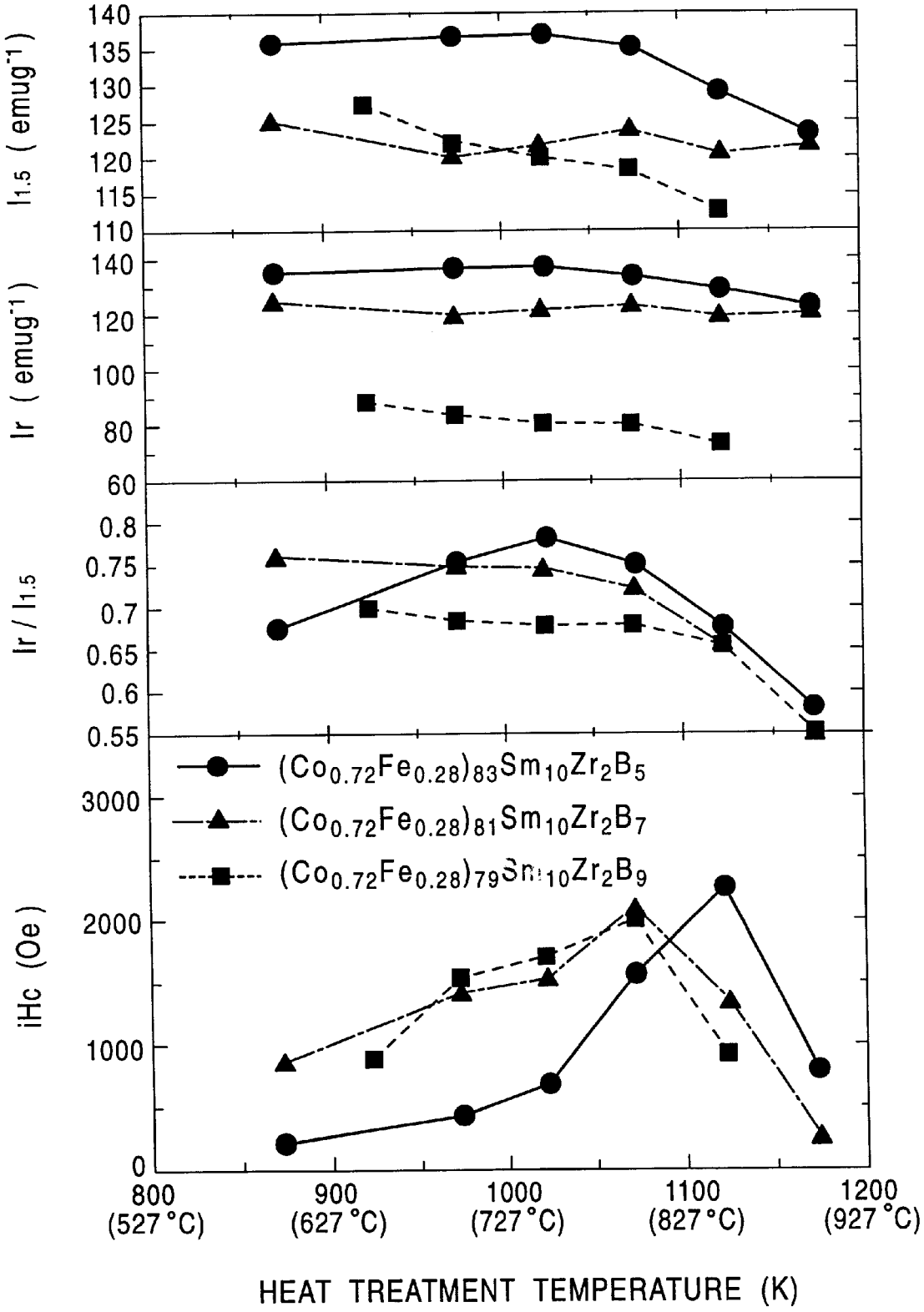
FIG. 4 is a graph showing the dependence of magnetization ($I_{1.5}$), remanent magnetization (Ir), remanence ratio ($Ir/I_{1.5}$) and coercive force (iHc) on heat treatment temperature of a quenched ribbon having each of the compositions $(Co_{0.72}Fe_{0.28})_{83}Sm_{10}Zr_2B_5$, $(Co_{0.72}Fe_{0.28})_{81}Sm_{10}Zr_2B_7$ and $(Co_{0.72}Fe_{0.28})_{79}Sm_{10}Zr_2B_9$.

On the other hand, FIG. 4 indicates that in the ribbon samples having the composition $(Co_{0.72}Fe_{0.28})_{88-t}Sm_{10}Zr_2B_t$ (t=5, 7 and 9) in which Nb of the ribbon samples shown in FIG. 3 was substituted by Zr, the remanence ratio (Ir/Is) gradually decreases as the heat treatment temperature increases from 1023 K (750° C.), and the coercive force (iHc) becomes maximum in 1073 to 1123 K.

It is also found that the samples of $(Co_{0.72}Fe_{0.28})_{88-t}Sm_{10}Nb_2B_t$ shown in FIG. 3 have higher coercive force (iHc) than the samples containing Zr shown in FIG. 4.

It is futher found that in regard to magnetization ($I_{1.5}$) and remanent magnetization (Ir), the samples containing Zr have higher magnetization ($I_{1.5}$) and remanent magnetization (Ir) than the samples containing Nb.

Figure 5:
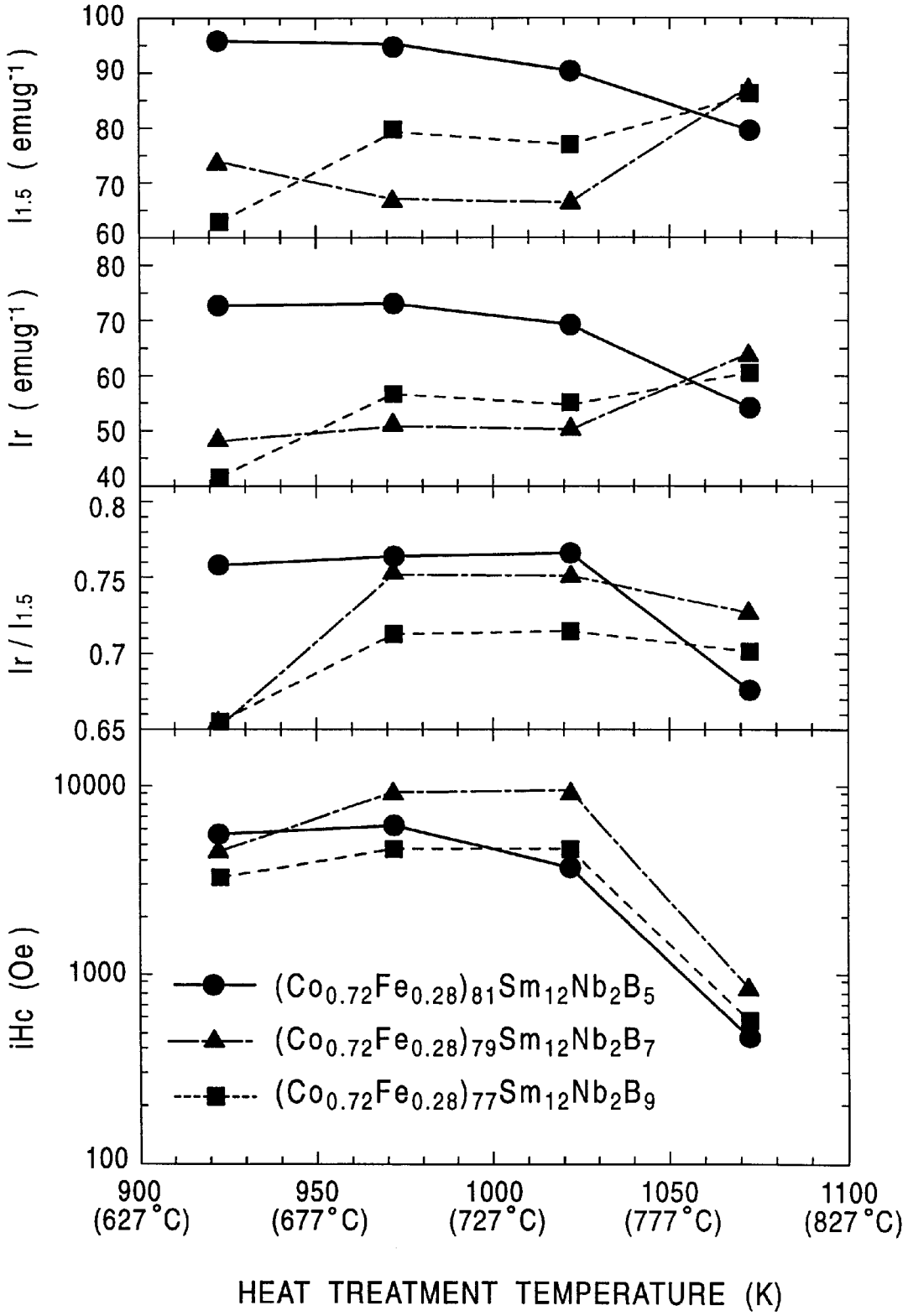
FIG. 5 is a graph showing the dependence of magnetization ($I_{1.5}$), remanent magnetization (Ir), remanence ratio ($Ir/I_{1.5}$) and coercive force (iHc) on heat treatment temperature of a quenched ribbon having each of the compositions $(Co_{0.72}Fe_{0.28})_{81}Sm_{12}Nb_2B_5$, $(Co_{0.72}Fe_{0.28})_{79}Sm_{12}Nb_2B_7$ and $(Co_{0.72}Fe_{0.28})_{77}Sm_{12}Nb_2B_9$.

FIG. 5 shows that in the samples having the composition $(Co_{0.72}Fe_{0.28})_{86-t}Sm_{12}Nb_2B_t$ (t=5, 7 and 9), the coercive force (iHc) is 3 to 9 kOe in the range of heat treatment temperatures of 923 K (650 C.) to 1023 K (750 C.), and is higher than the coercive force (iHc) of the samples of $(Co_{0.72}Fe_{0.28})_{88-t}Sm_{10}Nb_2B_t$ shown in FIG. 3.

Figure 6:
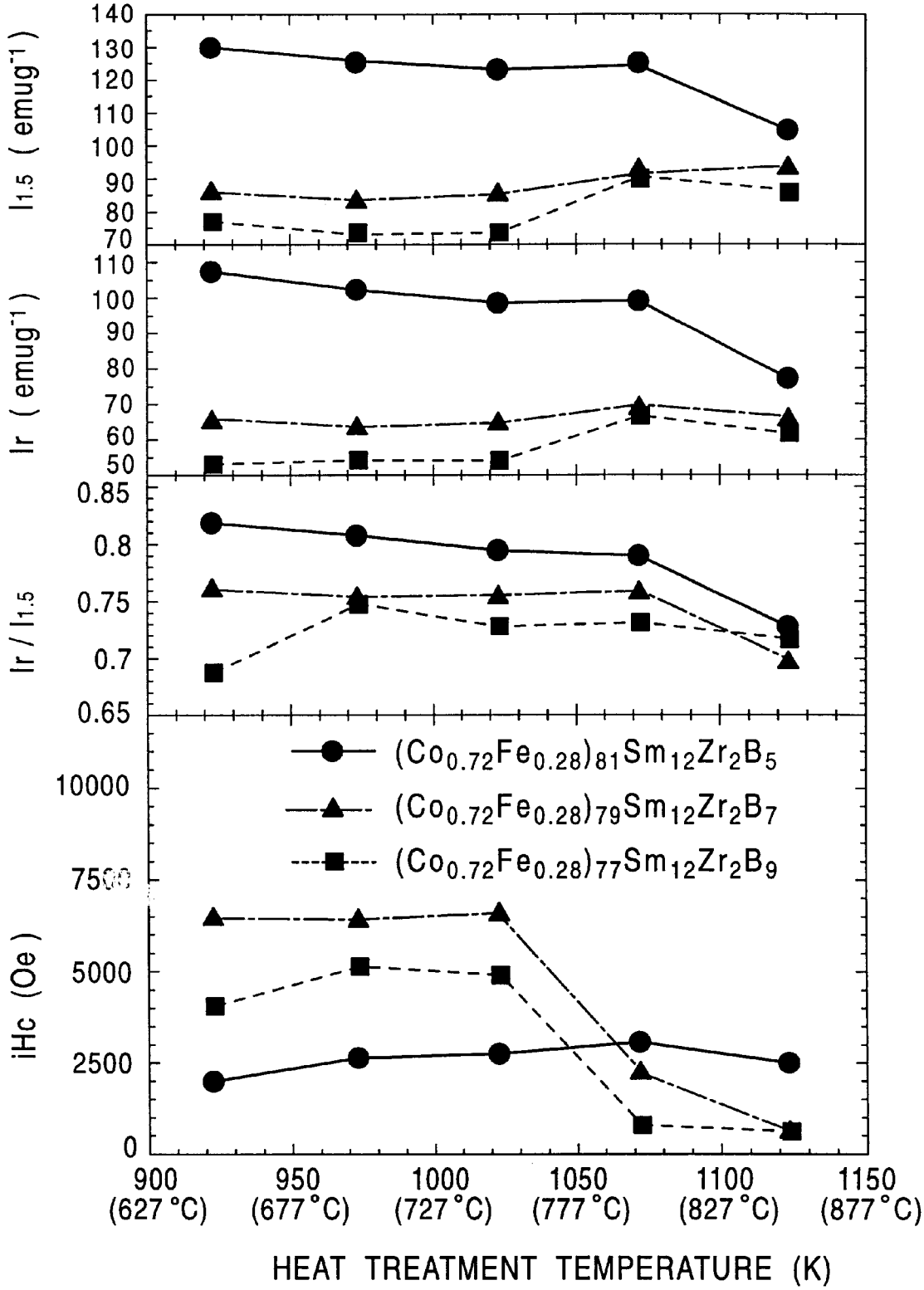
FIG. 6 is a graph showing the dependence of magnetization ($I_{1.5}$), remanent magnetization (Ir), remanence ratio ($Ir/I_{1.5}$) and coercive force (iHc) on heat treatment temperature of a quenched ribbon having each of the compositions $(Co_{0.72}Fe_{0.28})_{81}Sm_{12}Zr_2B_5$, $(Co_{0.72}Fe_{0.28})_{79}Sm_{12}Zr_2B_7$ and $(Co_{0.72}Fe_{0.28})_{77}Sm_{12}Zr_2B_9$.

FIG. 6 indicates that in the ribbon samples having the composition $(Co_{0.72}Fe_{0.28})_{86-t}Sm_{12}Zr_2B_t$ (t=5, 7 and 9) in which Nb of the ribbon samples shown in FIG. 5 was substituted by Zr, the coercive force (iHc) is lower than the samples (FIG. 5) containing Nb, but magnetization ($I_{1.5}$) and remanent magnetization (Ir) are higher than the samples containing Nb.

Figure 7:
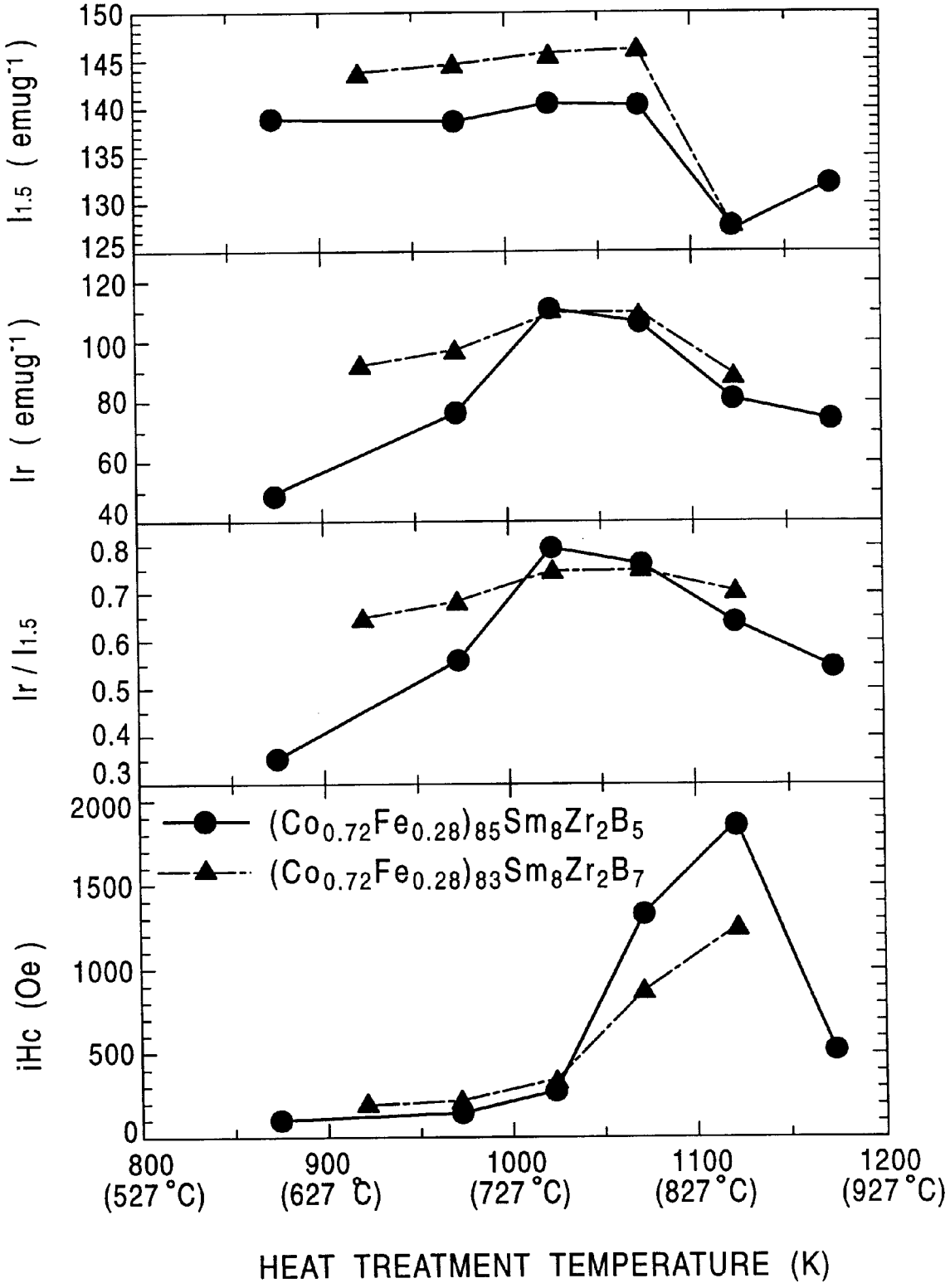
FIG. 7 is a graph showing the dependence of magnetization ($I_{1.5}$), remanent magnetization (Ir), remanence ratio ($Ir/I_{1.5}$) and coercive force (iHc) on heat treatment temperature of a quenched ribbon having each of the compositions $(Co_{0.72}Fe_{0.28})_{85}Sm_8Zr_2B_5$ and $(Co_{0.72}Fe_{0.28})_{83}Sm_8Zr_2B_7$.

FIG. 7 indicates that in the samples having the composition $(Co_{0.72}Fe_{0.28})_{90-t}Sm_8Zr_2B_t$ (t=5 and 7), the coercive force (iHc) abruptly increases as the heat treatment temperature increases from 1023 K (750° C.), but the maximum is 2 kOe slightly lower than the samples having the other compositions.

Figure 8:
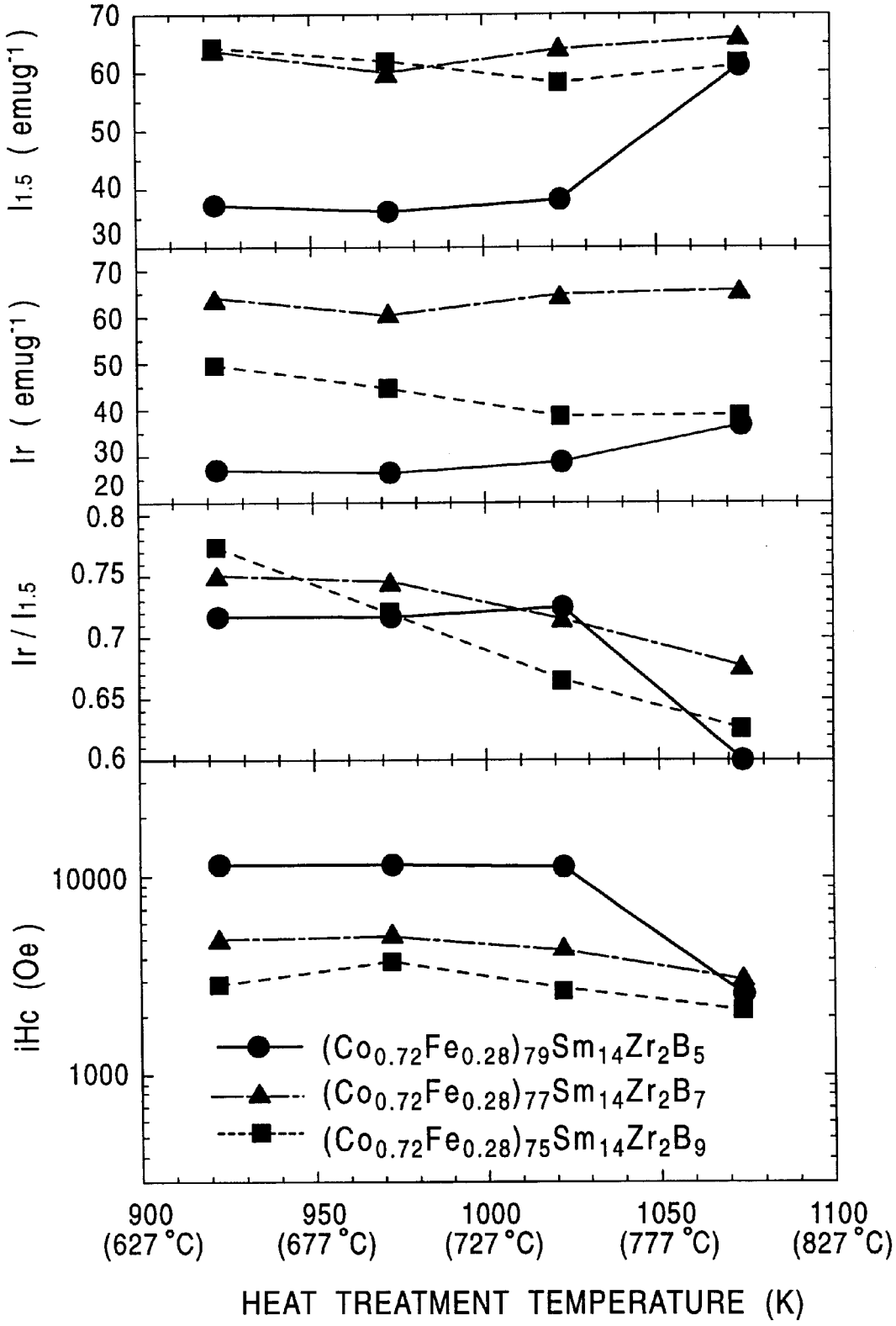
FIG. 8 is a graph showing the dependence of magnetization ($I_{1.5}$), remanent magnetization (Ir), remanence ratio ($Ir/I_{1.5}$) and coercive force (iHc) on heat treatment temperature of a quenched ribbon having each of the compositions $(Co_{0.72}Fe_{0.28})_{79}Sm_{14}Zr_2B_5$, $(Co_{0.72}Fe_{0.28})_{77}Sm_{14}Zr_2B_7$; and $(Co_{0.72}Fe_{0.28})_{75}Sm_{14}Zr_2B_9$.

FIG. 8 reveals that in the samples having the composition $(Co_{0.72}Fe_{0.28})_{84-t}Sm_{14}Zr_2B_t$ (t=5, 7 and 9), the coercive force (iHc) and the remanence ratio ($Ir/I_{1.5}$) tend to decrease as the heat treatment temperature increases from 1023 K (750° C.), and the sample having the composition $(Co_{0.72}Fe_{0.28})_{79}Sm_{14}Zr_2B_5$ shows a coercive force (iHc) of 10 kOe or more in the range of heat treatment temperatures of 923 K (650° C.) to 1023 K (750° C.).

Figure 9:
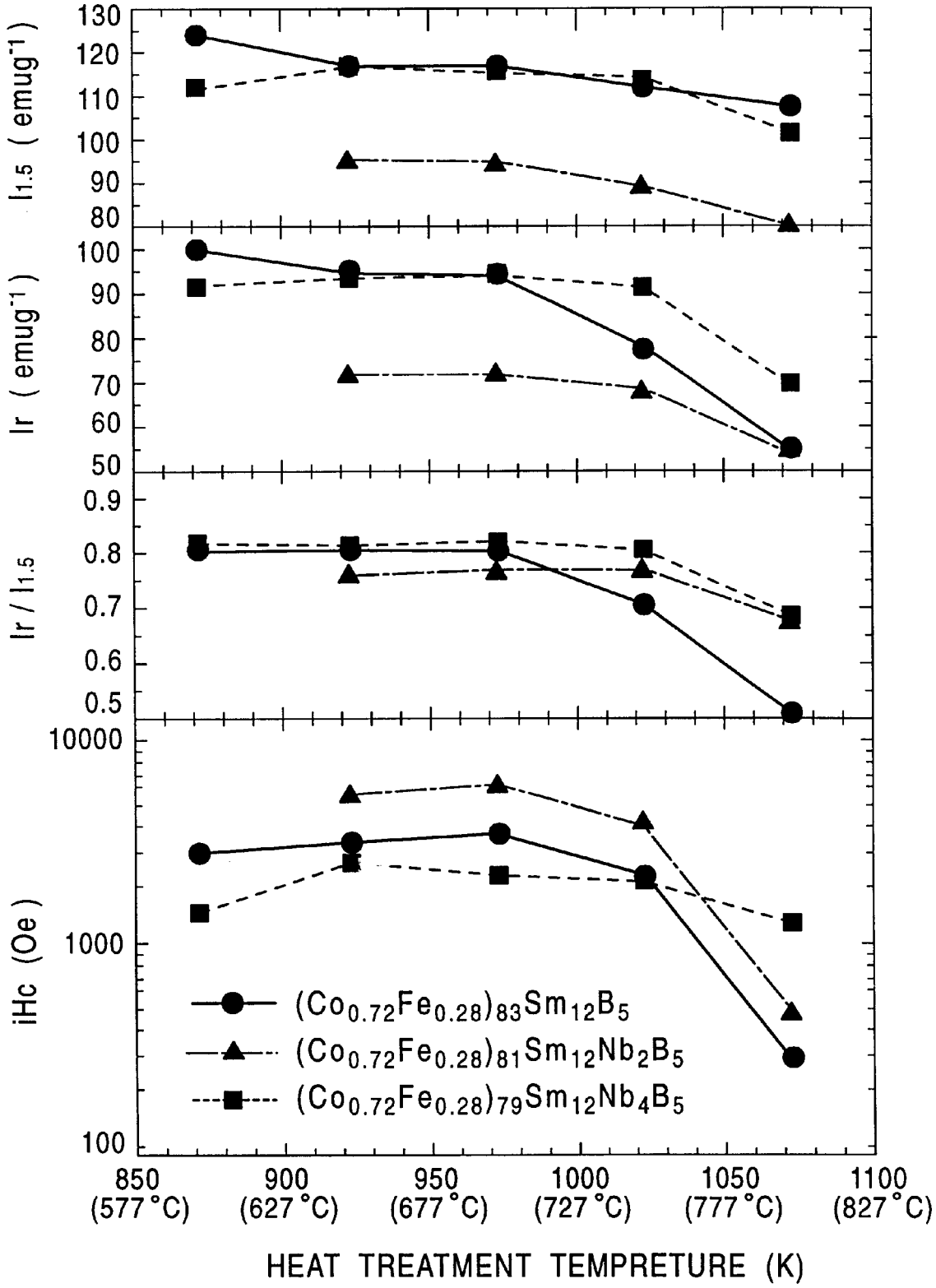
FIG. 9 is a graph showing the dependence of magnetization ($I_{1.5}$), remanent magnetization (Ir), remanence ratio ($Ir/I_{1.5}$) and coercive force (iHc) on heat treatment temperature of a quenched ribbon having each of the compositions $(Co_{0.72}Fe_{0.28})_{83}Sm_{12}B_5$, $(Co_{0.72}Fe_{0.28})_{81}Sm_{12}Nb_2B_5$ and $(Co_{0.72}Fe_{0.28})_{79}Sm_{12}Nb_4B_5$.

FIG. 9 indicates that in the samples having the composition $(Co_{0.72}Fe_{0.28})_{83-t}Sm_{12}Nb_tB_5$ (t=0, 2 and 4), the magnetization ($I_{1.5}$) remanent magnetization (Ir), and the remanence ratio ($Ir/I_{1.5}$) rapidly deteriorate as the heat treatment temperature increases from 1023 K (750° C.). It is also found that with respect to the dependence of each of the characteristics on the amount of Nb added, the sample having the composition in which t=2 has low magnetization ($I_{1.5}$) and remanent magnetization (Ir), but a coercive force (iHc) of as high as 6 kOe or more, as compared with the sample in which t=4.

Figure 10:
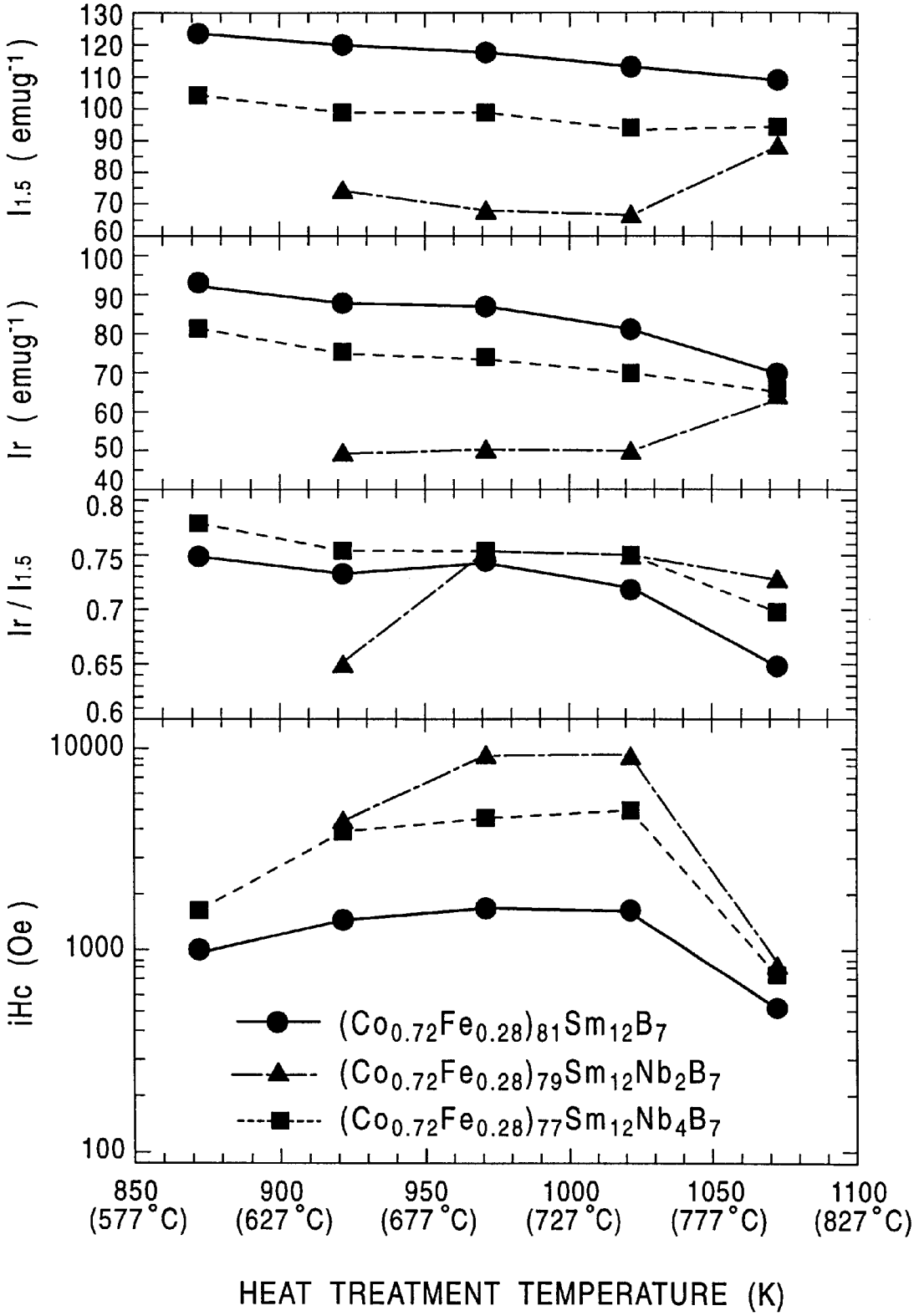
FIG. 10 is a graph showing the dependence of magnetization ($I_{1.5}$), remanent magnetization (Ir), remanence ratio ($Ir/I_{1.5}$) and coercive force (iHc) on heat treatment temperature of a quenched ribbon having each of the compositions $(Co_{0.72}Fe_{0.28})_{81}Sm_{12}B_7$, $(Co_{0.72}Fe_{0.28})_{79}Sm_{12}Nb_2B_7$ and $(Co_{0.72}Fe_{0.28})_{77}Sm_{12}Nb_4B_7$.

FIG. 10 indicates that the samples having the composition $(Co_{0.72}Fe_{0.28})_{81-t}Sm_{12}Nb_tB_7$ (t=0, 2 and 4) show the same tendency as the samples shown in FIG. 9, i.e., each of the characteristics deteriorates as the heat treatment temperature increases from 1023 K (750° C.). The sample having the composition in which t=2 shows a coercive force (iHc) of as high as 9 kOe.

Figure 11:
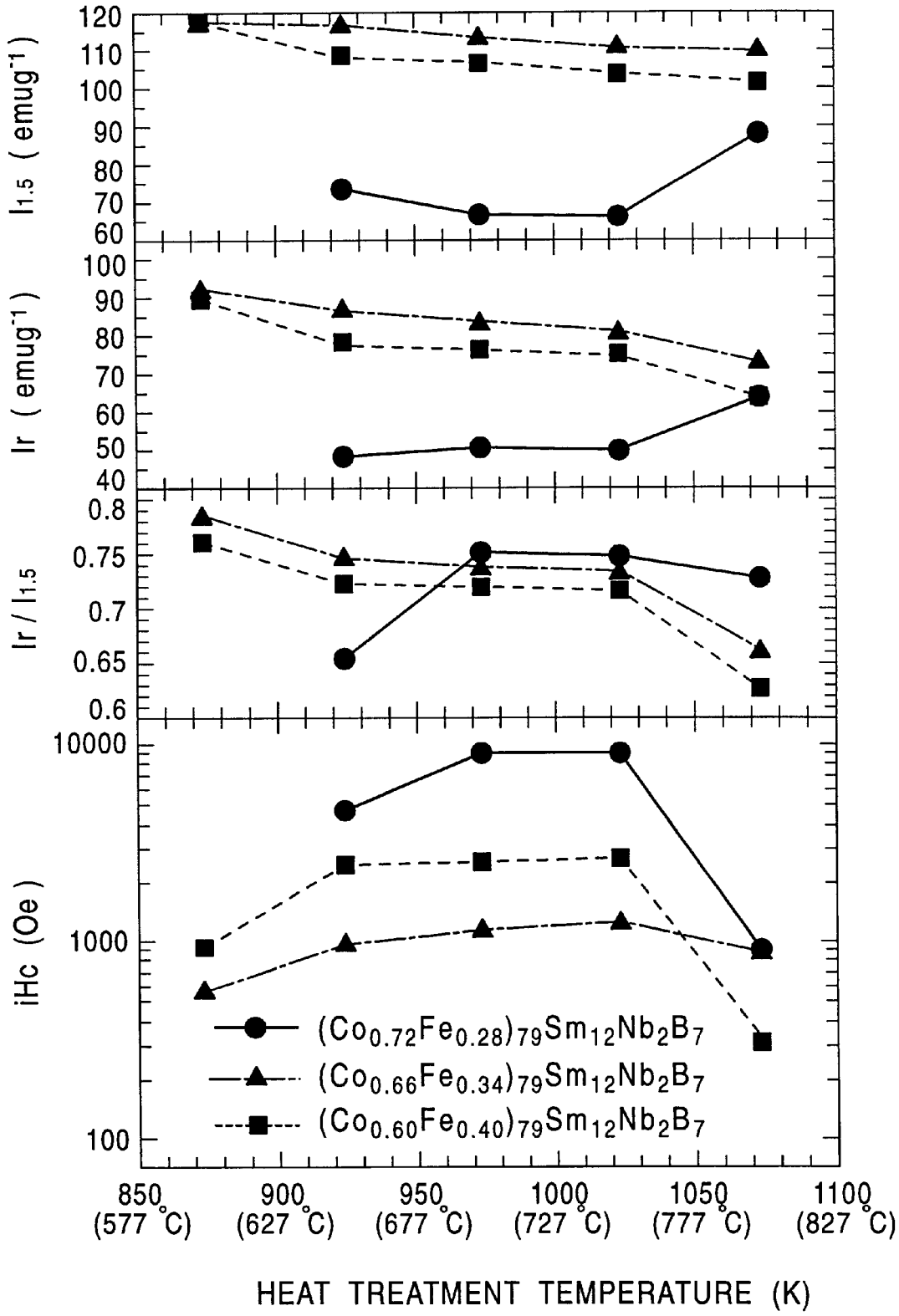
FIG. 11 is a graph showing the dependence of magnetization ($I_{1.5}$) remanent magnetization (Ir), remanence ratio ($Ir/I_{1.5}$) and coercive force (iHc) on heat treatment temperature of a quenched ribbon having each of the compositions $(Co_{0.72}Fe_{0.28})_{79}Sm_{12}Nb_2B_7$, $(Co_{0.66}Fe_{0.34})_{79}Sm_{12}Nb_2B_7$ and $(Co_{0.60}Fe_{0.40})_{79}Sm_{12}Nb_2B_7$.

FIG. 11 is a graph showing the dependence of each of the characteristics on the Co—Fe ratio and the heat treatment temperature. In the samples having the composition $(Co_{l-f}Fe_f)_{79}Sm_{12}Nb_2B_7$ (f=0.28, 0.34 and 0.4), magnetization ($I_{1.5}$) and remanent magnetization (Ir) decrease as the Co concentration increases, while the sample having the highest Co concentration in which t=0.28 shows a coercive force (iHc) of as high as 10 kOe in. the range of heat treatment temperatures of 973 K (700° C.) to 1023 K (750° C.).

Figure 12:
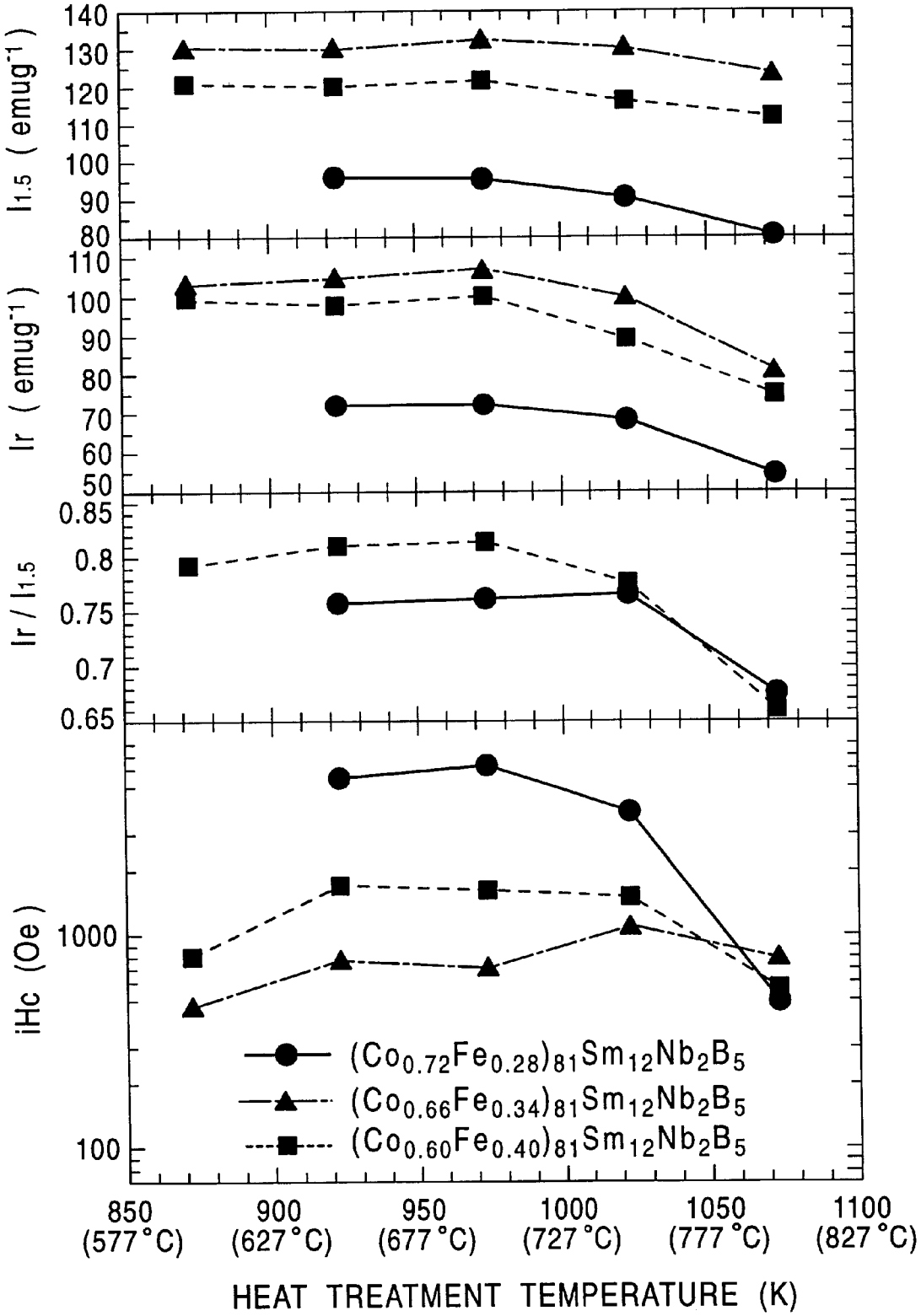
FIG. 12 is a graph showing the dependence of magnetization ($I_{1.5}$) remanent magnetization (Ir), remanence ratio ($Ir/I_{1.5}$) and coercive force (iHc) on heat treatment temperature of a quenched ribbon having each of the compositions $(Co_{0.72}Fe_{0.28})_{81}Sm_{12}Nb_2B_5$, $(Co_{0.66}Fe_{0.34})_{81}Sm_{12}Nb_2B_2$ and $(Co_{0.60}Fe_{0.40})_{81}Sm_{12}Nb_2B_5$.

Like FIG. 11, FIG. 12 is a graph showing the dependence of each of the characteristics on the Co—Fe ratio and heat treatment temperature with respect to the samples having the composition $(Co_{l-f}Fe_f)_{81}Sm_{12}Nb_2B_5$ (f=0.28, 0.34 and 0.4). Like in FIG. 11, magnetization ($I_{1.5}$) and remanent magnetization (Ir) decrease as the Co concentration increases, while the sample having the highest Co concentration in which t=0.28 shows a coercive force (iHc) of 7 kOe in the range of heat treatment temperatures of 923 K (650° C.) to 973 K (700° C.), which is higher than the samples having the compositions in which f=0.34 and 0.4. Particularly, in the sample in which f =0.28, the coercive force (iHc) rapidly deteriorates as the heat treatment temperature increases from 1023 K (750° C.).

As described above, all samples have a remanence ratio ($Ir/I_{1.5}$) of over 0.6, and have a nano-composite texture and exchange coupling characteristics.

Example 3

Quenched ribbons having the compositions $(Co_{0.72}Fe_{0.28})_{77}Sm_{12}Zr_2B_9$ and $(Co_{0.72}Fe_{0.28})_{81}Sm_{12}Nb_tB_5$were obtained by the same method as Example 1.

Each of the quenched ribbons was subjected to heat treatment under conditions in which the heating rate was 3 k/min, the heat treatment temperature was 650 to 850° C., and the holding time was 3 minutes, to obtain ribbon samples.

The texture states of the thus-obtained ribbon samples were examined by X-ray diffraction analysis. The results are shown in FIGS. 13 and 14.

Figure 13:
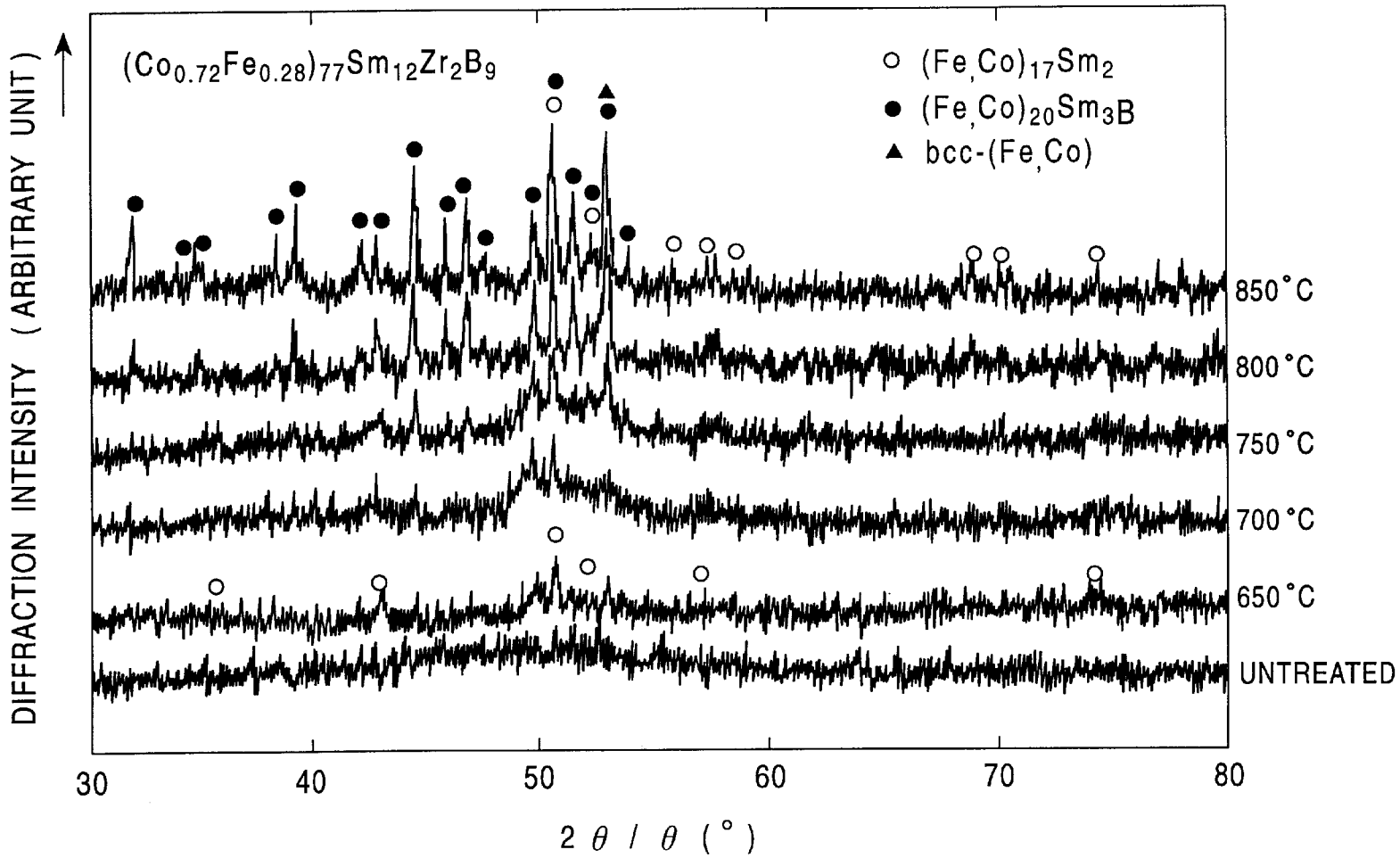
FIG. 13 is a chart showing the results of X-ray diffraction measurement of a ribbon sample obtained by heat treatment of a quenched ribbon having the composition $(Co_{0.72}Fe_{0.28})_{77}Sm_{12}Zr_2B_9$ at 650 to 850° C.
Figure 14:
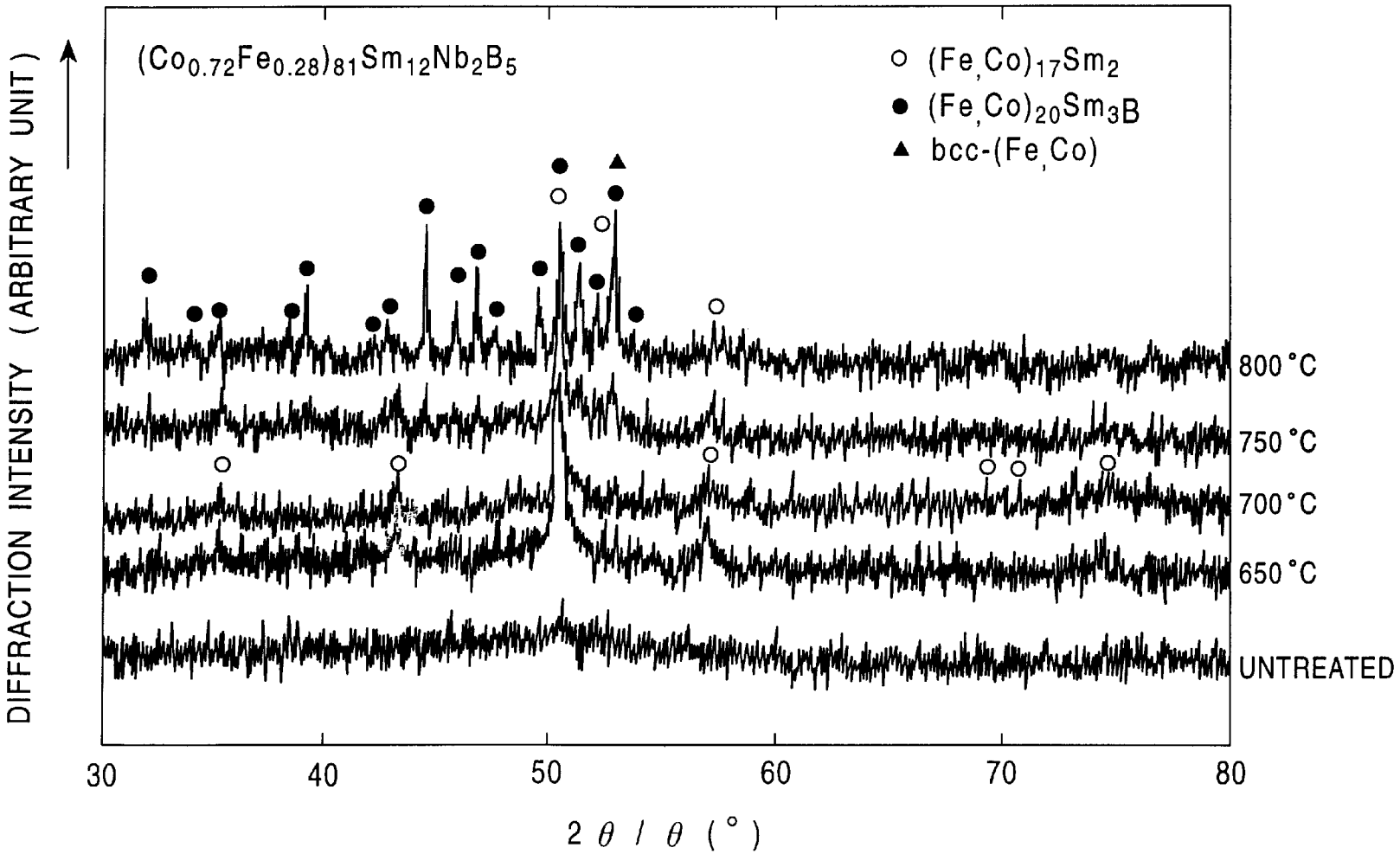
FIG. 14 is a chart showing the results of X-ray diffraction measurement of a ribbon sample obtained by heat treatment of a quenched ribbon having the composition $(Co_{0.72}Fe_{0.28})_{81}Sm_{12}Nb_2B_5$ at 600 to 800° C.

FIGS. 13 and 14 indicate that the quenched ribbon before heat treatment shows a halo pattern, and thus comprises a single amorphous phase.

The precipitation of a $(Fe, Co)_{17}Sm_2$ phase starts at a heat treatment temperature of about 650° C., and the precipitation of a $(Fe, Co)_{20}Sm_3B$ phase or bcc-(FeCo) phase is observed in the case of a heat treatment temperature over 700° C.

In this way, in the hard magnetic material of the present invention, the precipitation of a fine crystalline phase is started by heat treatment. Since the crystalline phase contains a hard magnetic phase comprising the $(Fe, Co)_{17}Sm_2$ phase, and a soft magnetic phase comprising the $(Fe, Co)_{20}Sm_3B$ phase or bcc-(FeCo) phase, the hard magnetic material of the present invention is found to be a magnet exhibiting good exchange coupling characteristics.

A Co phase as a soft magnetic phase could not be detected in the diffraction patterns. This is thought to be due to a small amount of precipitation or insufficient crystal growth.

Example 4

Quenched ribbons having the compositions $(Co_{0.72}Fe_{0.28})_{77}Sm_{12}Zr_2B_9$, $(Co_{0.72}Fe_{0.28})_{79}Sm_{12}Zr_2B_7$, $(Co_{0.72}Fe_{0.28})_{81}Sm_{12}Nb_2B_5$ and $(Co_{0.72}Fe_{0.28})_{79}Sm_{12}Nb_2B_7$ were obtained by the same method as Example 1.

Each of the thus-obtained quenched ribbons was ground by using a rotor mill in air to form a powder. The obtained powder was sorted to obtain a powder having a grain size of 37 to 107 $\mu$m which was used as a raw material power in the subsequent step.

Figure 15:
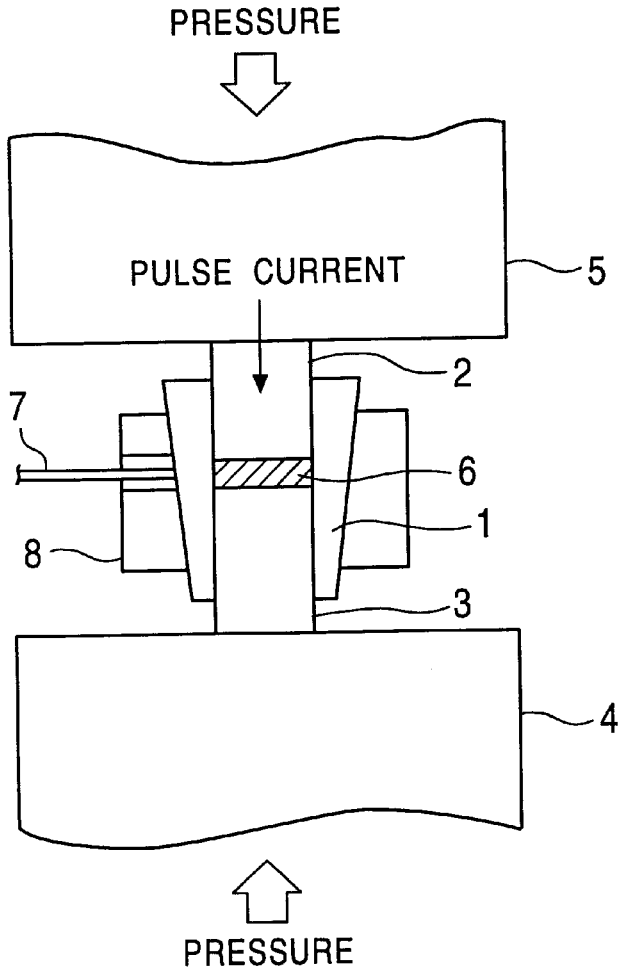
FIG. 15 is a sectional view showing the structure of a principal portion of an example of a spark plasma sintering apparatus used for producing a bulk of the hard magnetic material of the present invention.
Figure 16:
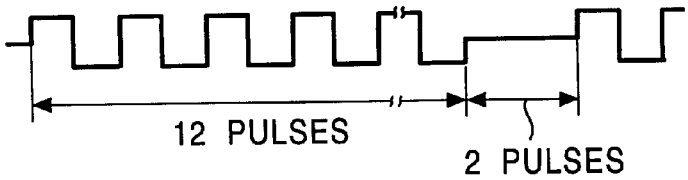
FIG. 16 is a drawing showing an example of a pulse current waveform applied to a raw material powder in the spark plasma sintering apparatus shown in FIG. 15.

A WC die was filled with 2 g of the raw material powder by using a hand press, and then placed in the plasma sintering apparatus shown in FIG. 15. The inside of a chamber was pressurized by upper and lower punches in an atmosphere of $3\times10^{-5}$ torr, and at the same time, a pulse wave was passed through the raw material powder from a current-carrying device to heat the powder. The pulse wave comprised the 12 pulses passed and 2 pulses in a subsequent quiescent period, as shown in FIG. 16, so that the raw material powder was heated with a current of 4700 to 4800 A maximum.

Figure 17A:
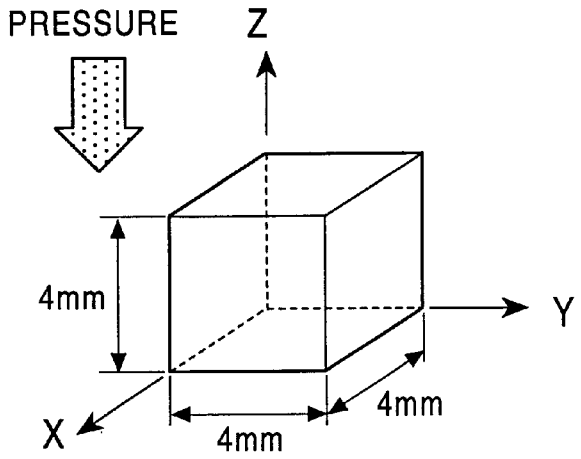
FIG. 17A is a perspective view showing a bulk having a size of 4×4×4 mm.
Figure 17B:
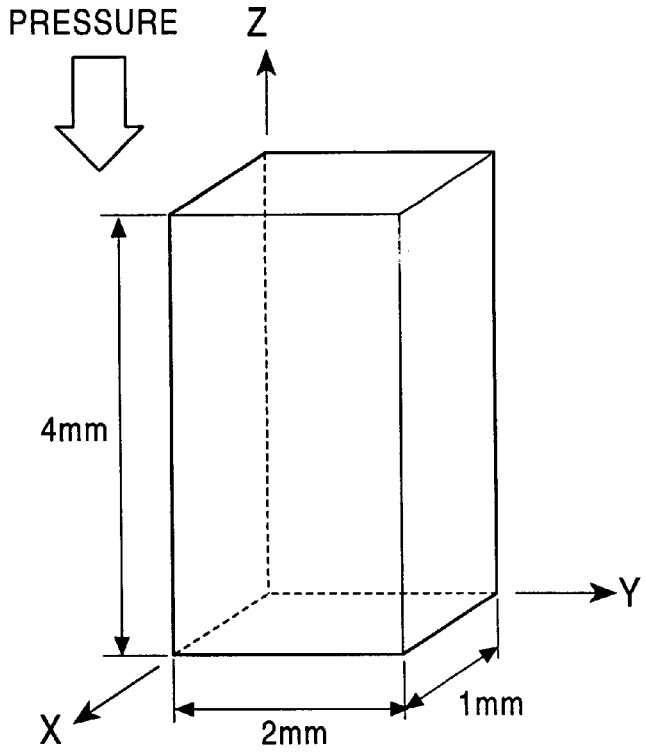
Figure 18:
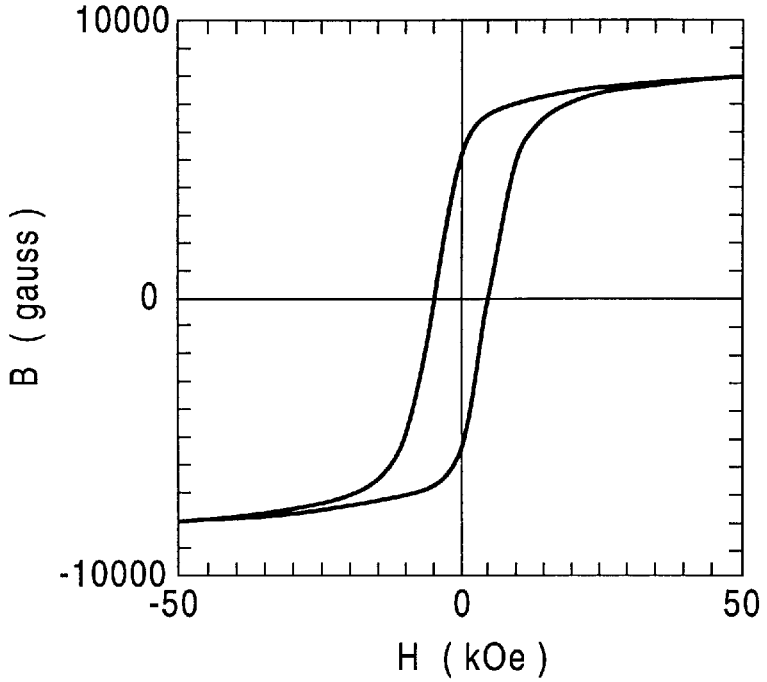
FIG. 18 is a graph showing a B-H loop measurement by applying a magnetic filed to a bulk sample (4×4×4 mm) having the composition $(Co_{0.72}Fe_{0.28})_{77}Sm_{12}Zr_2B_9$ in the X axis direction thereof.
Figure 19:
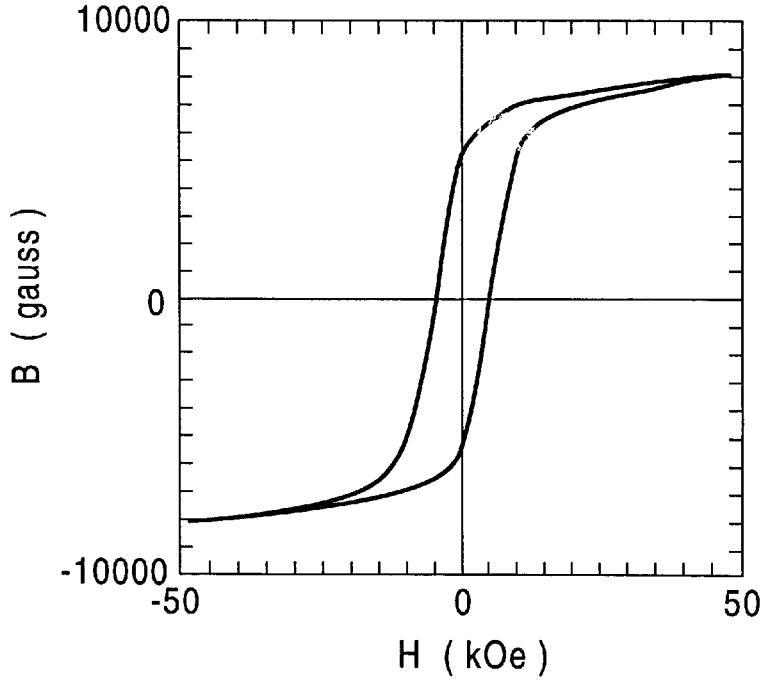
FIG. 19 is a graph showing a B-H loop measurement by applying a magnetic filed to a bulk sample (4×4×4 mm) having the composition $(Co_{0.72}Fe_{0.28})_{77}Sm_{12}Zr_2B_9$ in the Y axis direction thereof.
Figure 20:
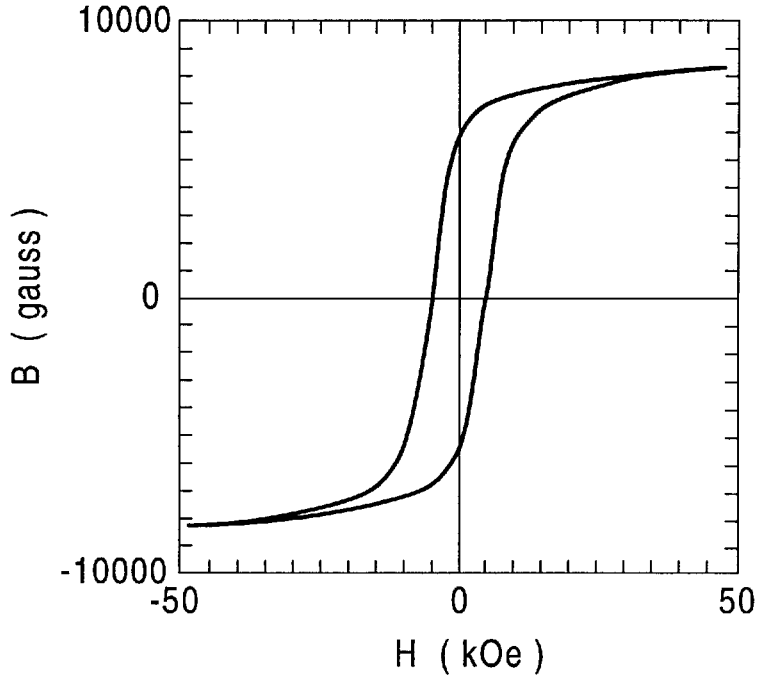
FIG. 20 is a graph showing a B-H loop measurement by applying a magnetic filed to a bulk sample (4×4×4 mm) having the composition $(Co_{0.72}Fe_{0.28})_{77}Sm_{12}Zr_2B_9$ in the Z axis direction thereof.
Figure 21:
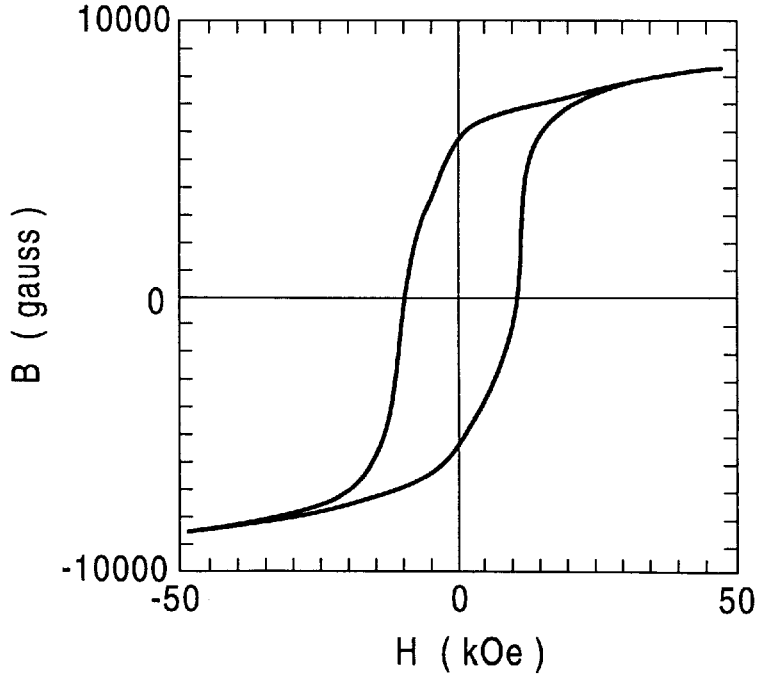
FIG. 21 is a graph showing a B-H loop measurement by applying a magnetic filed to a bulk sample (4×4×4 mm) having the composition $(Co_{0.72}Fe_{0.28})_{79}Sm_{12}Zr_2B_7$ in the X axis direction thereof.
Figure 22:
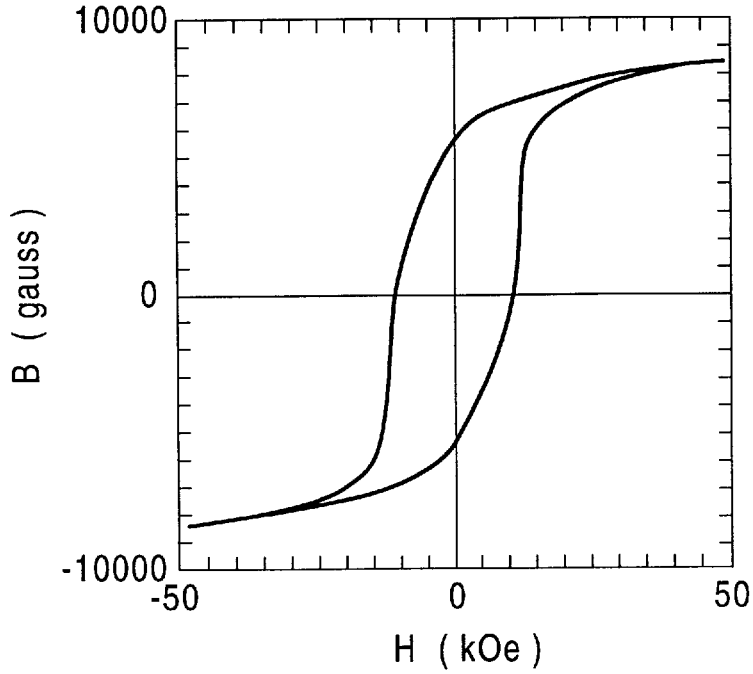
FIG. 22 is a graph showing a B-H loop measurement by applying a magnetic filed to a bulk sample (4×4×4 mm) having the composition $(Co_{0.72}Fe_{0.28})_{79}Sm_{12}Zr_2B_7$ in the Y axis direction thereof.
Figure 23:
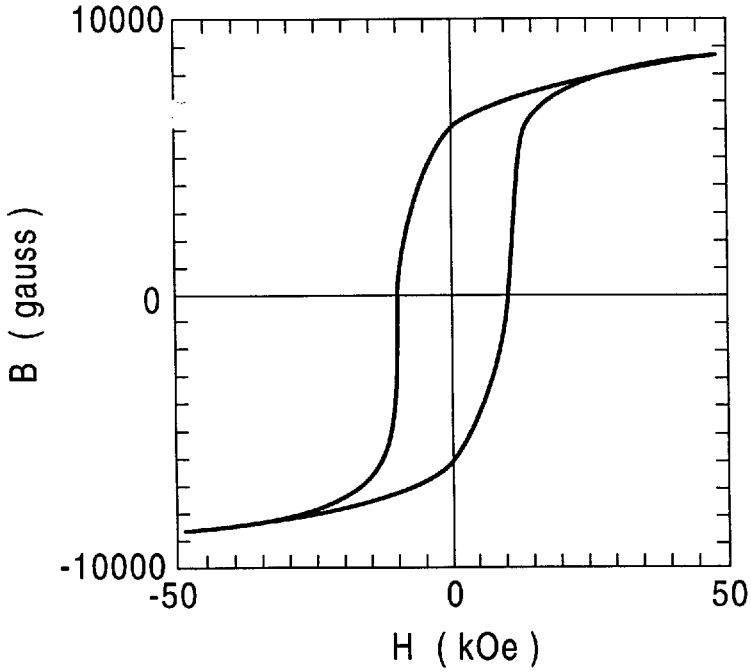
FIG. 23 is a graph showing a B-H loop measurement by applying a magnetic filed to a bulk sample (4×4×4 mm) having the composition $(Co_{0.72}Fe_{0.28})_{79}Sm_{12}Zr_2B_7$ in the Z axis direction thereof.
Figure 24:
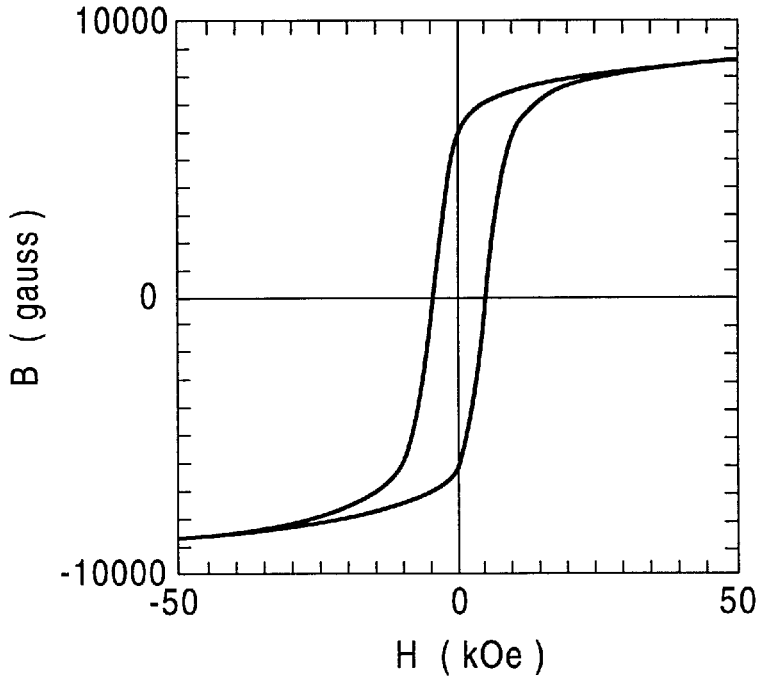
FIG. 24 is a graph showing a B-H loop measurement by applying a magnetic filed to a bulk sample (1×2×4 mm) having the composition $(Co_{0.72}Fe_{0.28})_{77}Sm_{12}Zr_2B_9$ in the Z axis direction thereof.
Figure 25:
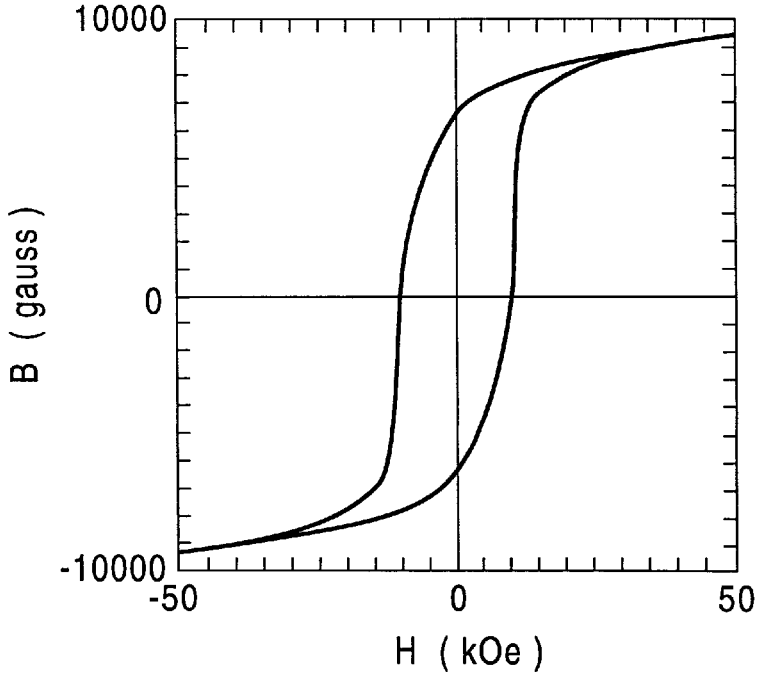
FIG. 25 is a graph showing a B-H loop measurement by applying a magnetic filed to a bulk sample (1×2×4 mm) having the composition $(Co_{0.72}Fe_{0.28})_{79}Sm_{12}Zr_2B_7$ in the Z axis direction thereof.

The sample was sintered by heating from room temperature to 600° C. and then held for about 8 minutes with the pressure of 636 MPa applied, to simultaneously perform sintering and heat treatment. As a result, a cubic bulk sample of 4×4×4 mm and a rectangular bulk sample of 1×2×4 mm were obtained, in which pressure was applied in the Z direction, as shown in FIGS. 17A and 17B.

The plasma sintering apparatus used for sintering and heat treatment comprises a WC die 1, a WC upper punch 2 and lower punch 3, which are inserted into the die 1, a WC outer frame die 8 provided outside the die 1, a base 4 for supporting the lower punch 3 and serving as one of electrodes for passing the pulse current, a base 5 for pressing downward the upper punch 2 and serving as the other electrode for passing the pulse current, and a thermocouple 7 held between the upper and lower punches 2 and 3, for measuring the temperature of an alloy powder 6, as shown in FIG. 15.

In order to produce an intended bulk by using the spark plasma sintering apparatus shown in FIG. 15, for example, the alloy power 6 is set between the upper and lower punches 2 and 3, and the inside of the spark plasma sintering apparatus is evacuated with the pressure applied from the upper and lower punches 2 and 3, to mold the alloy powder. At the same time, for example, the pulse current shown in FIG. 16 was applied to the alloy powder 6 to heat the alloy at the crystallization temperature of an alloy comprising an amorphous phase as a main phase or a temperature near the crystallization temperature for a predetermined time, to crystallize the alloy under stress.

Tables 1 and 2 show the hard magnetic characteristics of the thus-obtained bulk samples, and Table 3 shows the sintering temperature, the pressure, the density, and the relative density. Table 4 shows the magnetic characteristics in the Z direction of a bulk having each of compositions. FIGS. 18 to 25 show B-H loops.

Tables 1 and 2 show that in each of the samples, each of the measurements (magnetization (I1.5) in the applied magnetic field of 1.5 T, remanent magnetization (Ir), remanence ratio (Ir/I1.5), coercive force (iHc), and maximum magnetic energy product ($(BH)_{max}$)) in the Z direction is higher than those in the X direction and the Y direction. This indicates that magnetic anisotropy is applied in the direction of application of the pressure during sintering. Therefore, the remanent magnetization (Ir) can be increased.

Furthermore, the resultant bulks respectively have a cubic shape of 4×4×4 mm, and a rectangular shape of 1×2×4 mm, and such a small shape is provided with excellent hard magnetic characteristics.

Also Table 3 shows that the obtained bulks have a high density, and a relative density of 90.2 to 95.2%. Table 4 shows that the sample having each of the compositions has a magnetization ($I_{1.5}$) of 0.89 to 0.99 (T), a remanent magnetization (Ir) of 0.52 to 0.68 (T), a coercive force of 4.0 to 9.2 kOe, and a maximum magnetic energy product ($(BH)_{max}$)) of 4.1 to 7.0 (MGOe), and thus has excellent hard magnetic characteristics.

TABLE 1

| | Bulk size | $I_{1.5}$ (T) | | | Ir (T) | | | $Ir/I_{1.5}$ | | |
|---|---|---|---|---|---|---|---|---|---|---|
| Alloy composition | (mm) | X | Y | Z | X | Y | Z | X | Y | Z |
| $(Co_{0.72}Fe_{0.28})_{77}Sm_{12}Zr_2B_9$ | 4 × 4 × 4 | 8120 | 8100 | 8290 | 5590 | 5590 | 5760 | 0.69 | 0.69 | 0.70 |
| $(Co_{0.72}Fe_{0.28})_{79}Sm_{12}Zr_2B_7$ | 4 × 4 × 4 | 8730 | 8770 | 9010 | 5760 | 5770 | 6263 | 0.66 | 0.66 | 0.70 |
| $(Co_{0.72}Fe_{0.28})_{77}Sm_{12}Zr_2B_9$ | 1 × 2 × 4 | — | — | 8550 | — | — | 5900 | — | — | 0.69 |
| $(Co_{0.72}Fe_{0.28})_{79}Sm_{12}Zr_2B_7$ | 1 × 2 × 4 | — | — | 9460 | — | — | 9540 | — | — | 0.69 |
| $(Co_{0.72}Fe_{0.28})_{81}Sm_{12}Nb_2B_5$ | 4 × 4 × 4 | 9390 | 9410 | 9130 | 6540 | 6550 | 6520 | 0.70 | 0.70 | 0.71 |
| $(Co_{0.72}Fe_{0.28})_{79}Sm_{12}Nb_2B_7$ | 4 × 4 × 4 | 8621 | 8630 | 8610 | 6070 | 6080 | 6220 | 0.70 | 0.70 | 0.72 |

TABLE 2

| Alloy composition | Bulk size (mm) | mHc (kOe) X | mHc (kOe) Y | mHc (kOe) Z | $(BH)_{max}$ (MGOe) X | $(BH)_{max}$ (MGOe) Y | $(BH)_{max}$ (MGOe) Z |
|---|---|---|---|---|---|---|---|
| $(Co_{0.72}Fe_{0.28})_{77}Sm_{12}Zr_2B_9$ | 4 × 4 × 4 | 4.76 | 4.76 | 4.90 | 4.06 | 4.04 | 4.53 |
| $(Co_{0.72}Fe_{0.28})_{79}Sm_{12}Zr_2B_7$ | 4 × 4 × 4 | 10.0 | 10.0 | 9.79 | 5.46 | 5.47 | 7.03 |
| $(Co_{0.72}Fe_{0.28})_{77}Sm_{12}Zr_2B_9$ | 1 × 2 × 4 | — | — | 4.65 | — | — | 5.01 |
| $(Co_{0.72}Fe_{0.28})_{79}Sm_{12}Zr_2B_7$ | 1 × 2 × 4 | — | — | 9.84 | — | — | 7.84 |
| $(Co_{0.72}Fe_{0.28})_{81}Sm_{12}Nb_2B_5$ | 4 × 4 × 4 | 6.72 | 6.68 | 6.91 | 5.91 | 5.91 | 6.93 |
| $(Co_{0.72}Fe_{0.28})_{79}Sm_{12}Nb_2B_7$ | 4 × 4 × 4 | 8.63 | 8.62 | 9.01 | 5.72 | 5.70 | 6.93 |

TABLE 3

| Alloy composition | Sintering temperature (° C.) | Sintering pressure (MPa) | Density ($\times 10^{-3}$ (kg/m$^3$)) | Relative density (%) |
|---|---|---|---|---|
| $(Co_{0.72}Fe_{0.28})_{79}Sm_{12}Zr_2B_7$ | 600 | 636 | 7.75 | 93.4 |
| $(Co_{0.72}Fe_{0.28})_{77}Sm_{12}Zr_2B_9$ | 600 | 636 | 7.90 | 95.2 |
| $(Co_{0.72}Fe_{0.28})_{81}Sm_{12}Nb_2B_5$ | 600 | 636 | 7.51 | 90.5 |
| $(Co_{0.72}Fe_{0.28})_{79}Sm_{12}Nb_2B_7$ | 600 | 636 | 7.49 | 90.2 |

TABLE 4

| Alloy composition | $I_{1.5}$ (T) | Ir (T) | $Ir/I_{1.5}$ | iHc (kOe) | $(BH)_{max}$ (MGOe) |
|---|---|---|---|---|---|
| $(Co_{0.72}Fe_{0.28})_{79}Sm_{12}Ta_2B_7$ | 0.94 | 0.66 | 0.70 | 6.3 | 6.0 |
| $(Co_{0.72}Fe_{0.28})_{79}Sm_{10}Nd_2Nb_2B_7$ | 0.97 | 0.59 | 0.61 | 9.2 | 5.8 |
| $(Co_{0.72}Fe_{0.28})_{77}Sm_{12}Nd_2Nb_2B_7$ | 0.99 | 0.68 | 0.69 | 4.8 | 5.1 |
| $(Co_{0.72}Fe_{0.28})_{79}Sm_{10}Pr_2Nb_2B_7$ | 0.93 | 0.62 | 0.67 | 6.0 | 7.2 |
| $(Co_{0.72}Fe_{0.28})_{79}Sm_{10}Pr_2Zr_2B_7$ | 0.98 | 0.63 | 0.64 | 5.4 | 5.9 |
| $(Co_{0.72}Fe_{0.28})_{79}Sm_{12}Pr_2Nb_2B_5$ | 0.97 | 0.63 | 0.65 | 6.0 | 7.0 |
| $(Co_{0.72}Fe_{0.28})_{81}Sm_8Nd_6Nb_1B_4$ | 0.99 | 0.61 | 0.62 | 5.2 | 6.3 |
| $(Co_{0.72}Fe_{0.28})_{79}Sm_{10}Hf_3Nb_1B_7$ | 0.89 | 0.52 | 0.58 | 5.5 | 6.3 |
| $(Co_{0.72}Fe_{0.28})_{79}Sm_{14}Nd_2Nb_2B_3$ | 0.97 | 0.64 | 0.66 | 5.0 | 5.9 |
| $(Co_{0.72}Fe_{0.28})_{77}Sm_{14}Nd_4Nb_2B_3$ | 0.90 | 0.58 | 0.64 | 7.0 | 5.9 |
| $(Co_{0.72}Fe_{0.28})_{79}Sm_{12}Nd_2Ce_2Nb_2B_3$ | 0.98 | 0.68 | 0.69 | 4.9 | 5.2 |
| $(Co_{0.72}Fe_{0.28})_{79}Sm_8Pr_2Y_4Nd_2Nb_2B_3$ | 0.99 | 0.63 | 0.64 | 4.0 | 4.1 |

Example 5

Quenched ribbons having the compositions $(Co_{0.72}Fe_{0.28})_{77}Sm_{12}Zr_2B_9$, $(Co_{0.72}Fe_{0.28})_{79}Sm_{12}Zr_rB_7$, $(Co_{0.72}Fe_{0.28})_{81}Sm_{12}Zr_2B_5$, $(Co_{0.72}Fe_{0.28})_{81}Sm_{12}Nb_2B_5$, $(CO_{0.72}Fe_{0.28})_{79}Sm_{12}Nb_2B_7$, $(Co_{0.72}Fe_{0.28})_{77}Sm_{12}Nb_2B_9$, $(Co_{0.72}Fe_{0.28})_{81}Sm_{10}Nb_2B_7$ and $(Co_{0.72}Fe_{0.28})_{79}Sm_{10}Nb_2B_9$ were obtained by the same method as Example 1.

Each of the ribbon samples was subjected to heat treatment by heating to 873 K (600° C.) to 1173 K (900° C.) at a heating rate of 3 K/min in an infrared image furnace of $5\times10^{-5}$ Pa or less, and then holding for about 3 minutes to obtain a ribbon sample in which a fine crystalline phase was precipitated.

The thus-obtained ribbon sample was examined by a transmission electron microscope (TEM) to measure the average grain size of the fine crystalline phase. The results are shown in Table 5.

Table 5 shows that the ribbon samples, which experienced heat treatment at a temperature of 600° C. or more, have an average grain size of about 50 $\mu$m, and thus a fine crystalline phase is precipitated.

TABLE 5

| Alloy composition | Heat treatment temperature (° C.) | Average crystal grain size (nm) |
|---|---|---|
| $(Co_{0.72}Fe_{0.28})_{77}Sm_{12}Zr_2B_9$ | 700 | 50 |
| $(Co_{0.72}Fe_{0.28})_{79}Sm_{12}Zr_2B_7$ | 700 | 40 |
| $(Co_{0.72}Fe_{0.28})_{81}Sm_{12}Zr_2B_5$ | 700 | 50 |
| $(Co_{0.72}Fe_{0.28})_{81}Sm_{12}Nb_2B_5$ | 600 | 40 |
| $(Co_{0.72}Fe_{0.28})_{79}Sm_{12}Nb_2B_7$ | 750 | 50 |
| $(Co_{0.72}Fe_{0.28})_{77}Sm_{12}Nb_2B_9$ | 700 | 60 |

TABLE 5-continued

| Alloy composition | Heat treatment temperature (° C.) | Average crystal grain size (nm) |
|---|---|---|
| $(Co_{0.72}Fe_{0.28})_{81}Sm_{10}Nb_2B_7$ | 650 | 60 |
| $(Co_{0.72}Fe_{0.28})_{79}Sm_{10}Nb_2B_9$ | 700 | 50 |

Example 6

Quenched ribbons having the compositions $(Co_{1-f}Fe_f)_{86-y}Sm_{12}Nb_2B_y$, $(Co_{0.72}Fe_{0.28})_{88-x-y}Sm_{12}Nb_xB_y$, $(Co_{0.72}Fe_{0.28})_{98-x-y}Sm_yNb_2B_x$ and $(Co_{0.72}Fe_{0.28})_{98-x-y}Sm_yZr_2B_x$ were obtained by the same method as Example 1.

Each of the quenched ribbon alloys was subjected to heat treatment under conditions in which the heating rate was 3 K/min, the heat treatment temperature was 650 to 850° C., and the holding time was 3 minutes to obtain a ribbon sample.

For the thus-obtained sample, the coercive force (iHc), remanent magnetization (Ir) and magnetization ($I_{1.5}$) with the applied magnetization of 1.5 T were measured while changing the concentrations of Fe, Nb, B and Sm to various values to measure the dependency of each of the characteristics on the concentrations of these elements. The results obtained are shown in FIGS. 26 to 29.

Figure 26:
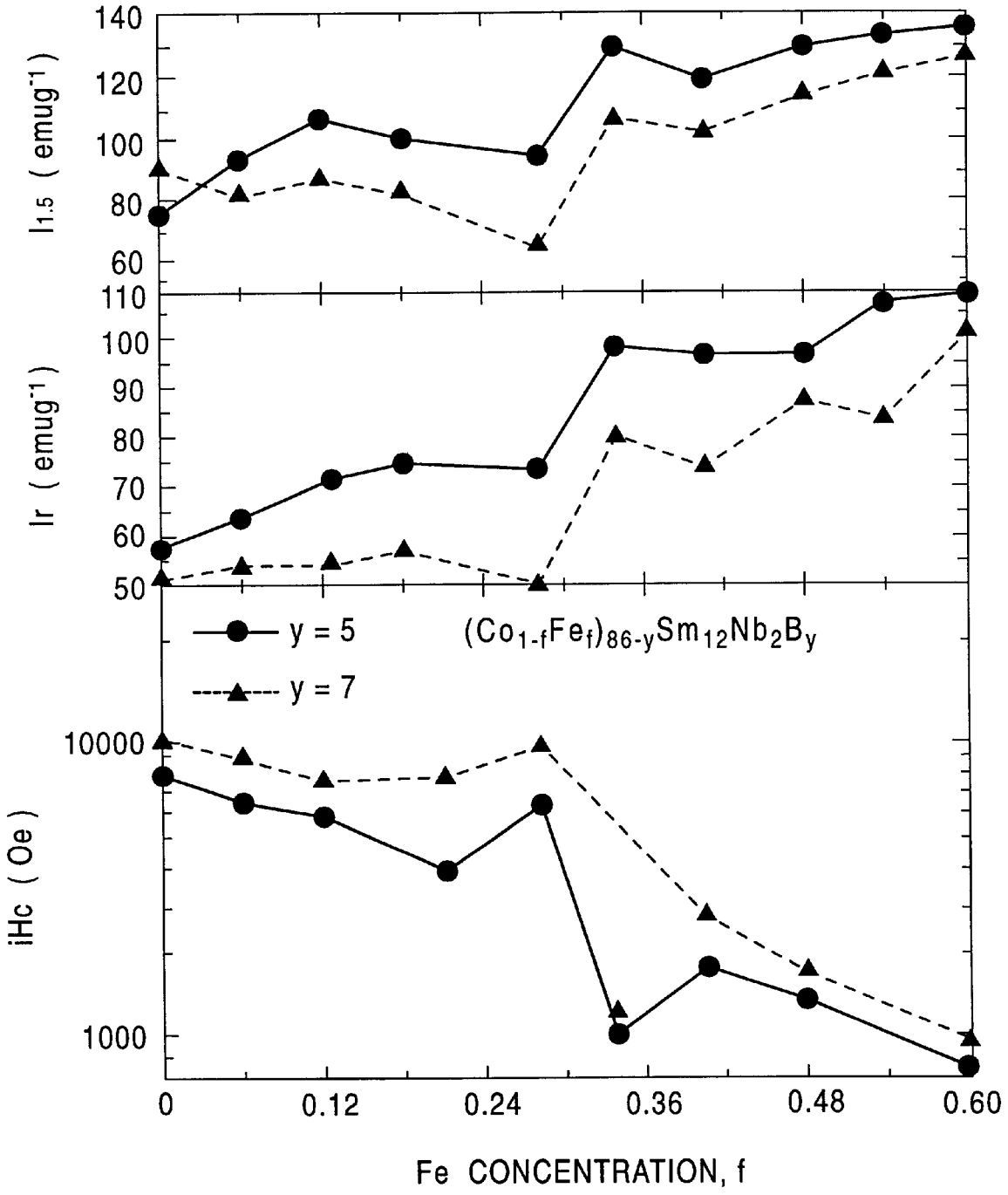
FIG. 26 is a graph showing the dependence of magnetization ($I_{1.5}$), remanent magnetization (Ir), and coercive force (iHc) on the Fe concentration (f) of a quenched ribbon having the composition $(Co_{l-f}Fe_f)_{86-y}Sm_{12}Nb_2B_y$ (y=5 and 7)

FIG. 26 shows the dependency of each of the characteristics on the Fe concentration (f) with respect to ribbon samples having the composition $(Co_{l-f}Fe_f)_{86-y}Sm_{12}Nb_2B_y$ (y=5 and 7 atomic %). FIG. 26 reveals that the sample having a B concentration of 7 atomic % has higher coercive force than the sample having a B concentration (y) of 5 atomic %, and remanent magnetization (Ir) and magnetization ($I_{1.5}$) tend to increase as the Fe concentration (f) increases. It is thus found that in order to obain a coercive force (iHc) of 1000 Oe or more while maintaining a high remanent magnetization (Ir) of 100 emu/g or more and a high magnetization ($I_{1.5l}$ ) $_{of}$ 80 emu/g or more, the Fe concentration (f) is preferably at least 0.5 or less.

Figure 27:
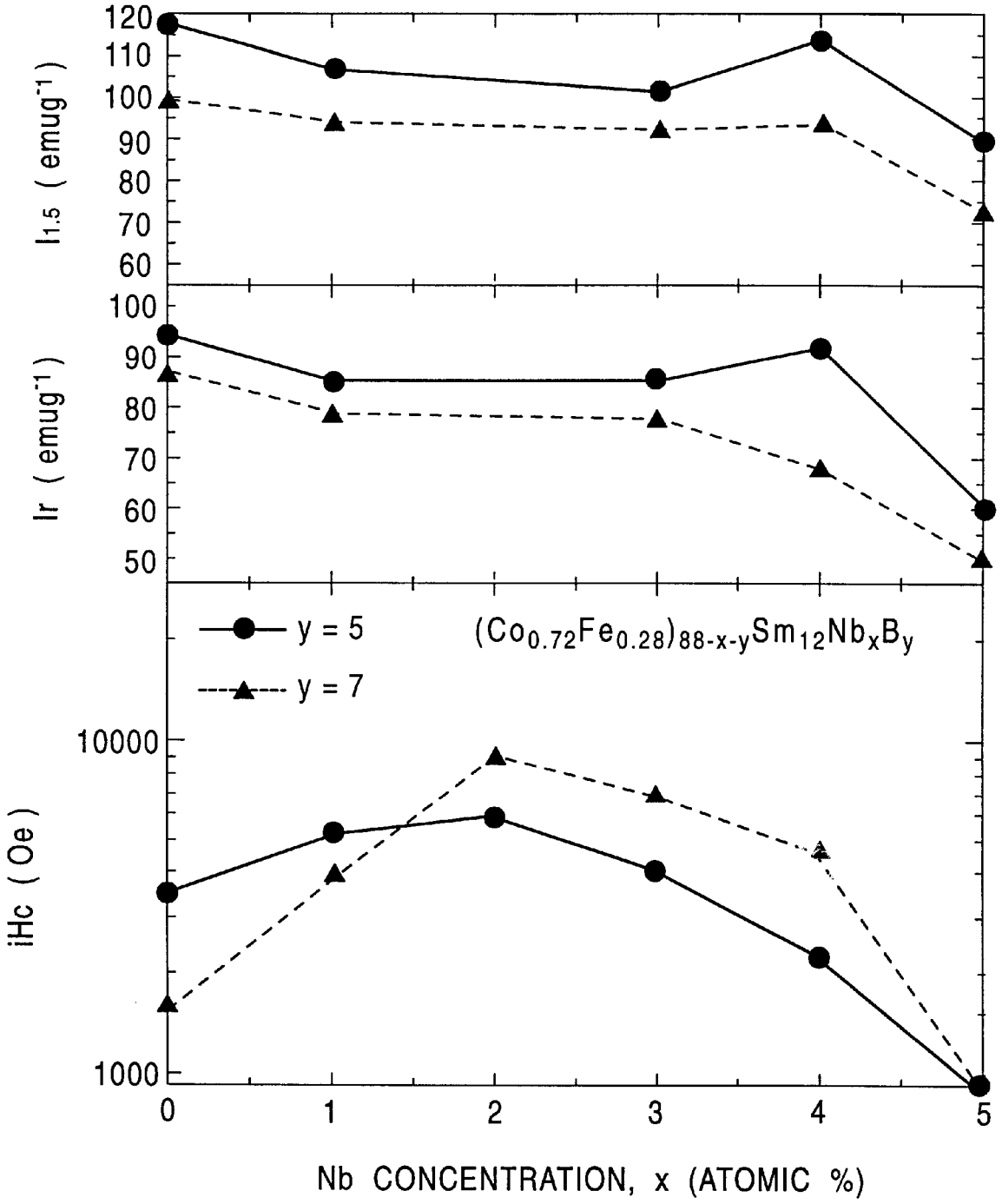
FIG. 27 is a graph showing the dependence of magnetization ($I_{1.5}$) remanent magnetization (Ir), and coercive force (iHc) on the Nb concentration (x) of a quenched ribbon having the composition $(CO_{0.72}Fe_{0.28})_{88-x-y}Sm_{12}Nb_xB_y$ (y=5 and 7)

FIG. 27 shows each of the characteristics of the ribbon samples having the composition $(Co_{0.72}Fe_{0.28})_{88-x-y}Sm_{12}Nb_xB_y$ (y=5, and 7 atomic %) when the Nb concentration (x) was changed in the range of 0 to 5 atomic %. FIG. 27 reveals that in both samples respectively having B concentrations (y) of 5 atomic % and 7 atomic %, particularly coercive force (iHc) is high at a Nb concentration (x) of 2 to 4 atomic %. FIG. 27 also indicates that in order to obtain a high coercive force (iHc) of 1000 Oe or more while maintaining high remanent magnetization (Ir) and high magnetization ($I_{1.5}$) the Nb concentration is preferably 0 to 4 atomic %.

Figure 28:
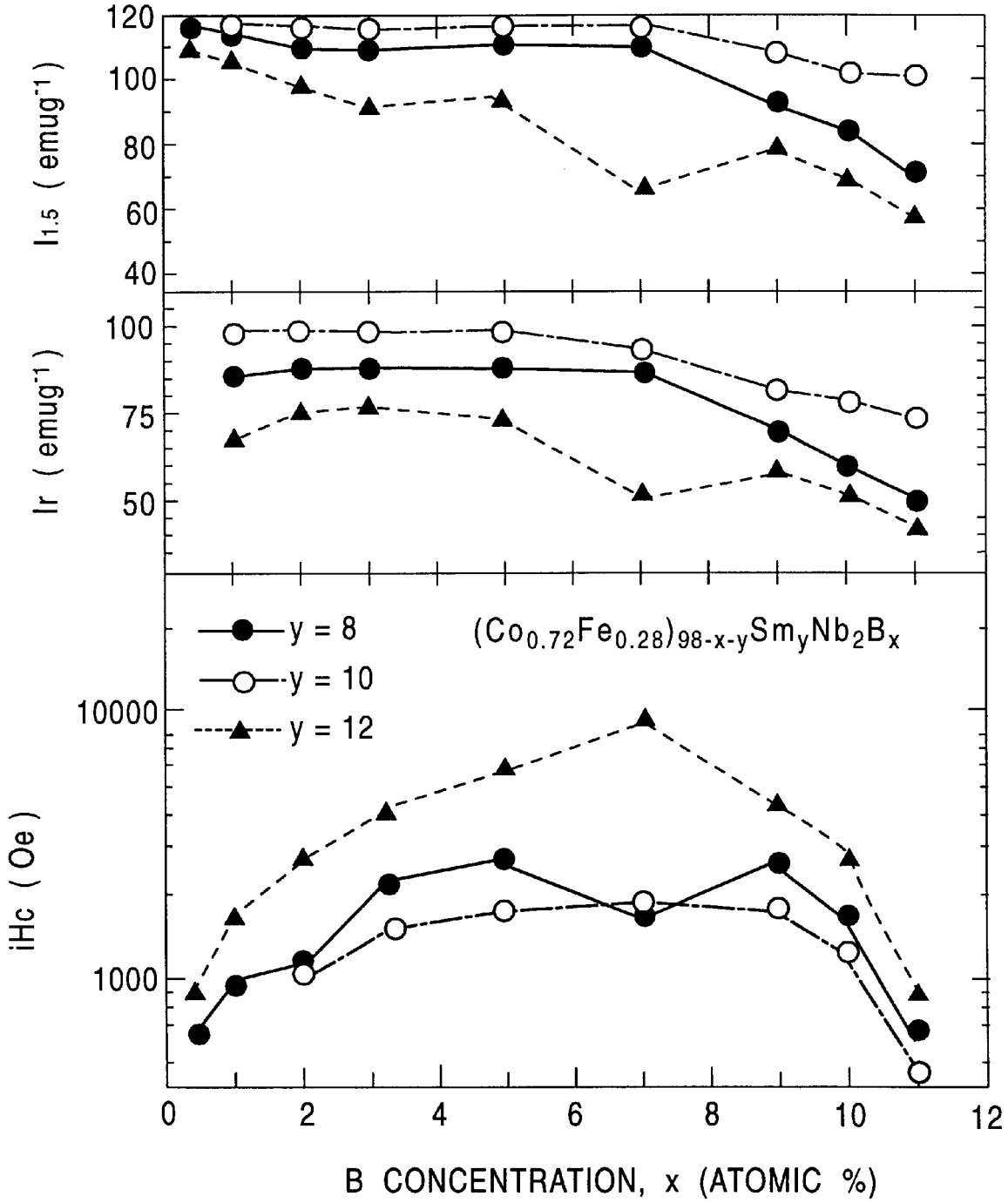
FIG. 28 is a graph showing the dependence of magnetization ($I_{1.5}$), remanent magnetization (Ir), and coercive force (iHc) on the B concentration (x) of a quenched ribbon having the composition $(Co_{0.72}Fe_{0.28})_{98-x-y}Sm_yNb_2B_x$ (y=8, 10 and 12)

FIG. 28 shows each of the characteristics of the ribbon samples having the composition $(Co_{0.72}Fe_{0.28})_{88-x-y}Sm_yNb_2B_x$ (y=8, 10 and 12 atomic %) when the B concentration (x) was changed in the range of 0.5 to 11 atomic %. FIG. 28 indicates that at a B concentration (x) of 0.5 to 10 atomic %, the sample having a Sm concentration (y) of 12 atomic % has a high coercive force (iHc) of 1000 Oe or more while maintaining high remanent magnetization (Ir) and high magnetization ($I_{1.5}$). Particularly, at a B concentration (x) of 9 atomic % or less, or 2 atomic % or more, higher coercive force can be obtained.

Figure 29:
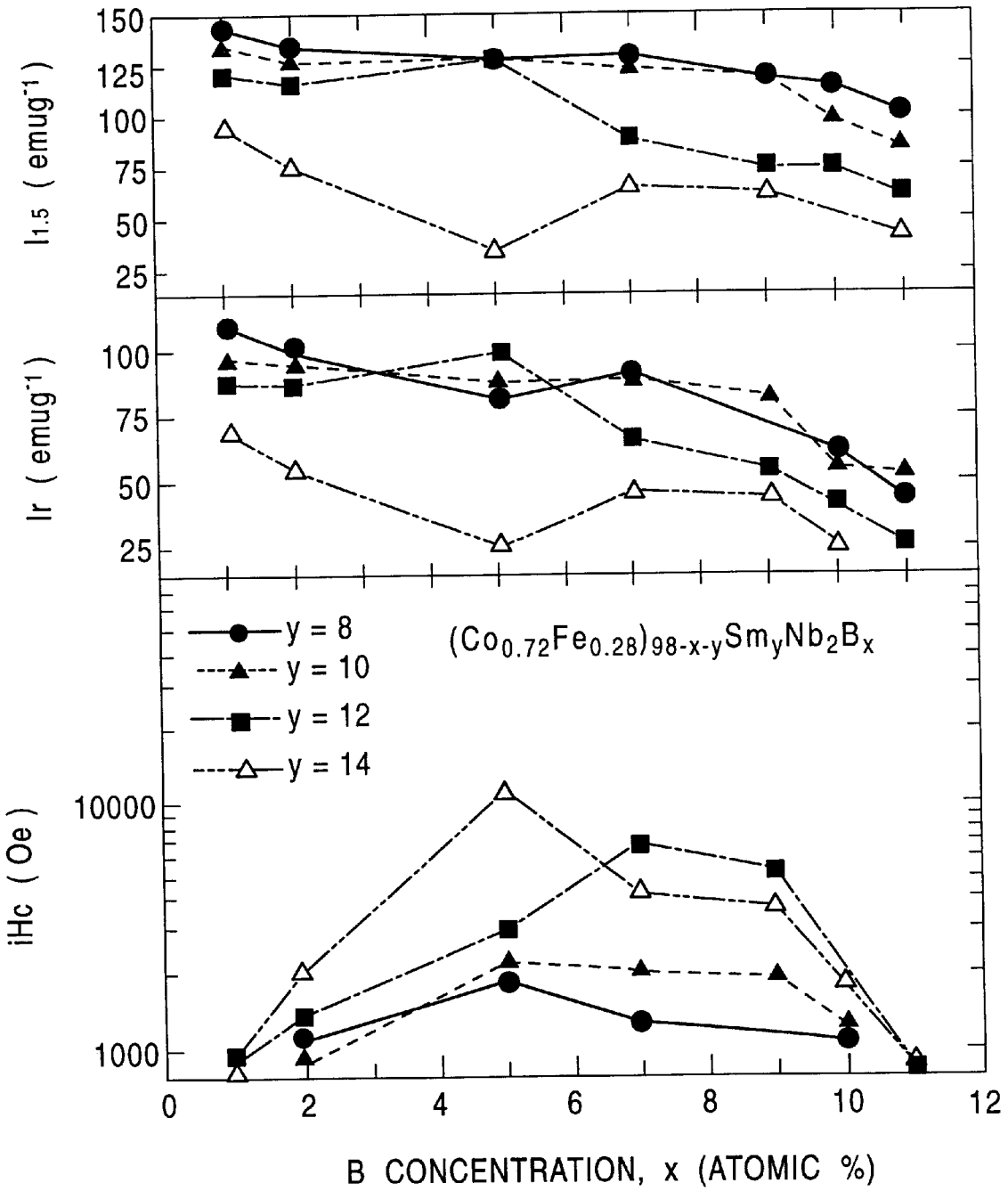
FIG. 29 is a graph showing the dependence of magnetization ($I_{1.5}$)) remanent magnetization (Ir), and coercive force (iHc) on. the B concentration (x) of a quenched ribbon having the composition $(CO_{0.72}Fe_{0.28})_{98-x-y}Sm_yZr_2B_x$ (y=8, 10, 12 and 14)

FIG. 29 shows each of the characteristics of the ribbon samples having the composition $(Co_{0.72}Fe_{0.28})_{88-x-y}Sm_yZr_2B_x$ (y=8, 10, 12 and 14 atomic %) when the B concentration (x) was changed in the range of 0.5 to 11 atomic %. FIG. 29 indicates that the sample having a B concentration (x) of 10 atomic % or less has a high coercive force (iHc) of 1000 Oe or more while maintaining high remanent magnetization (Ir) and high magnetization ($I_{1.5}$). It is also found that in order to securely obtain a coercive force (iHc) of 1000 Oe, the B concentration (x) is preferably 2 to 10 atomic %.

Example 7

Quenched ribbons comprising an amorphous phase and having the compositions $(Co_{0.72}Fe_{0.28})_{81}Nb_2Sm_{12}B_5$, $(Co_{0.72}Fe_{0.28})_{79}Nb_2Sm_{12}B_7$ and $(Co_{0.72}Fe_{0.28})_{80}Nb_2Sm_{13}B_5$ were obtained by the same method as Example 1.

Figure 30:
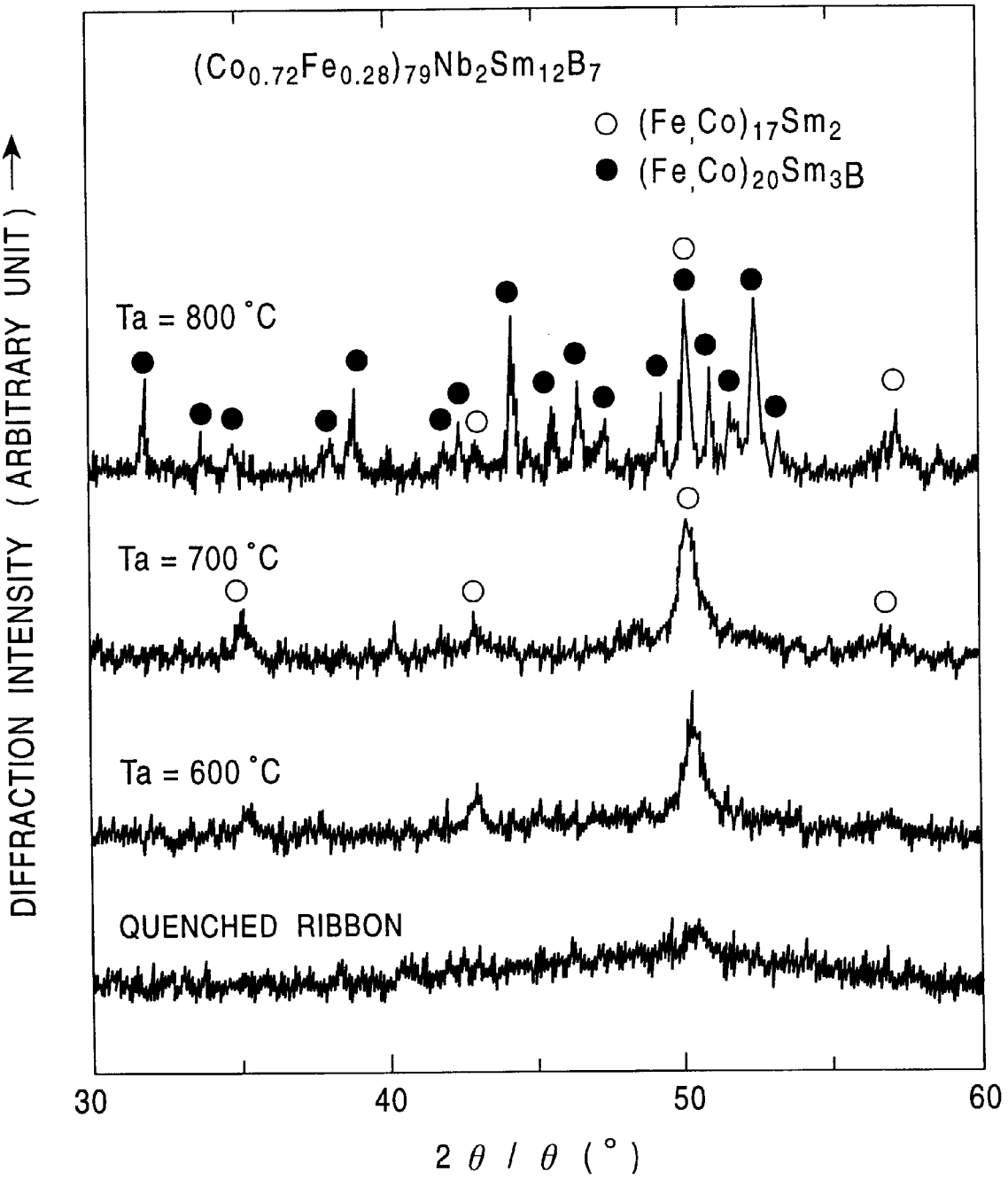
FIG. 30 is a chart showing the results of X-ray diffraction analysis of a ribbon sample having the composition $(Co_{0.72}Fe_{0.28})_{79}Nb_2Sm_{12}B_7$.

The quenched ribbon having the composition $(Co_{0.72}Fe_{0.28})_{79}Nb_2Sm_{12}B_7$ was subjected to heat treatment in an infrared image furnace of $5\times10^{-5}$ Pa or less under conditions in which the heating rate was 3 K/min, the heat treatment temperature (Ta) of 600° C., 700° C. and 800° C., and the holding time was 3 minutes to obtain ribbon samples in which a fine crystalline phase was precipitated. The texture state of each of the thus-obtained ribbon samples was examined by X-ray diffraction analysis. FIG. 30 shows a X-ray diffraction pattern of each of the ribbon samples.

In FIG. 30, in the ribbon sample which experienced heat treatment at 600° C., a diffraction peak of the $(Fe, Co)_{17}Sm_2$ phase is observed. In the case of heat treatment at 800° C., besides the $(Fe, Co)_7Sm_2$ phase, a diffraction peak of a $(Fe, Co)_{20}Sm_3B$ phase is also observed. In the case of treatment temperature at 700° C., which is thought to be optimum, no diffraction peak of a bcc-(Fe, Co) phase is observed. Therefore, in the ribbon samples of this example, magnetic characteristics are thought to be determined by exchange coupling characteristics of the $(Fe, Co)_{17}Sm_2$ phase serving as at least a hard magnetic phase, and the $(Fe, Co)_{20}Sm_3B$ Th phase or the residual amorphous phase serving as at least a soft magnetic phase.

Next, the quenched ribbons having the compositions $(Co_{0.72}Fe_{0.28})_{81}Nb_2Sm_{12}B_5$, $(Co_{0.72}Fe_{0.28})_{79}Nb_2Sm_{12}B_7$ and $(Co_{0.72}Fe_{0.28})_{80}Zr_2Sm_{13}B_5$ were examined by a differential scanning calorimeter (referred to as "DSC" hereinafter) to measure a DSC curve between 700 K (427° C.) and 1100 K (827° C.). The results are shown in FIG. 31.

Figure 31:
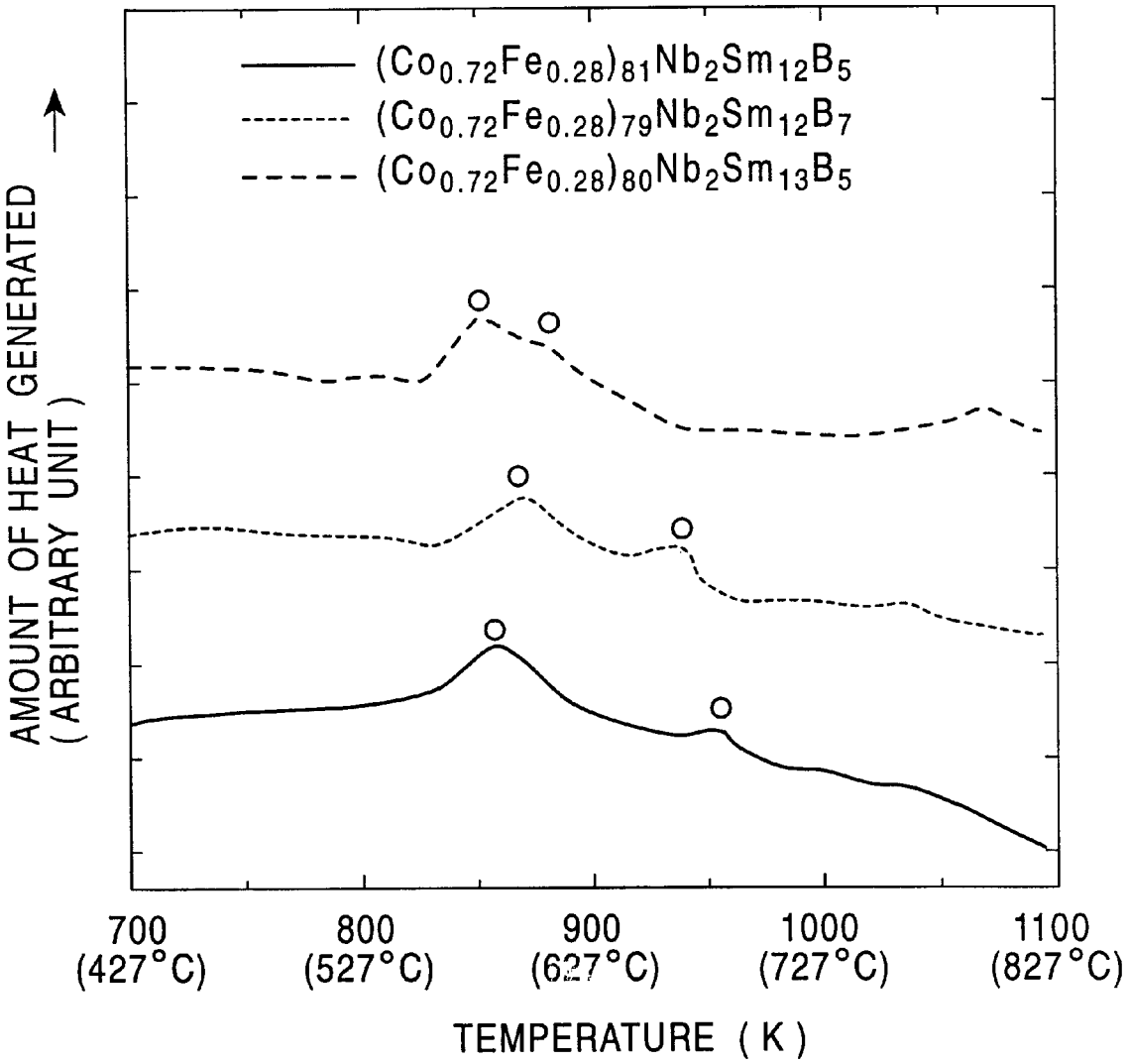
FIG. 31 is a chart showing a DSC curve of a ribbon sample having each of the compositions $(Co_{0.72}Fe_{0.28})_{81}Nb_2Sm_{12}B_5$, $(Co_{0.72}Fe_{0.28})_{79}Nb_2Sm_{12}B_7$ and $(Co_{0.72}Fe_{0.28})_{80}Nb_2Sm_{13}B_5$.

In FIG. 31, in each of the quenched ribbons, two exothermic peaks (marked with O) are observed between about 850 K (577° C.) to 950 K (677° C.).

For example, in the quenched ribbon having the composition $(Co_{0.72}Fe_{0.28})_{79}Nb_2Sm_{12}B_7$, in consideration of both the DSC curve shown in FIG. 31 and the X-ray diffraction pattern shown in FIG. 30, the exothermic peak near about 873 K (600° C.) shown in FIG. 31 is thought to be mainly due to heat generation in precipitation of the $(Fe, Co)_{17}Sm_2$ phase; the exothermic peak near about 930 K (657° C.) shown in FIG. 31 is thought to be mainly due to heat generation in precipitation of the $(Fe, Co)_{20}Sm_3B$ phase.

Figure 32:
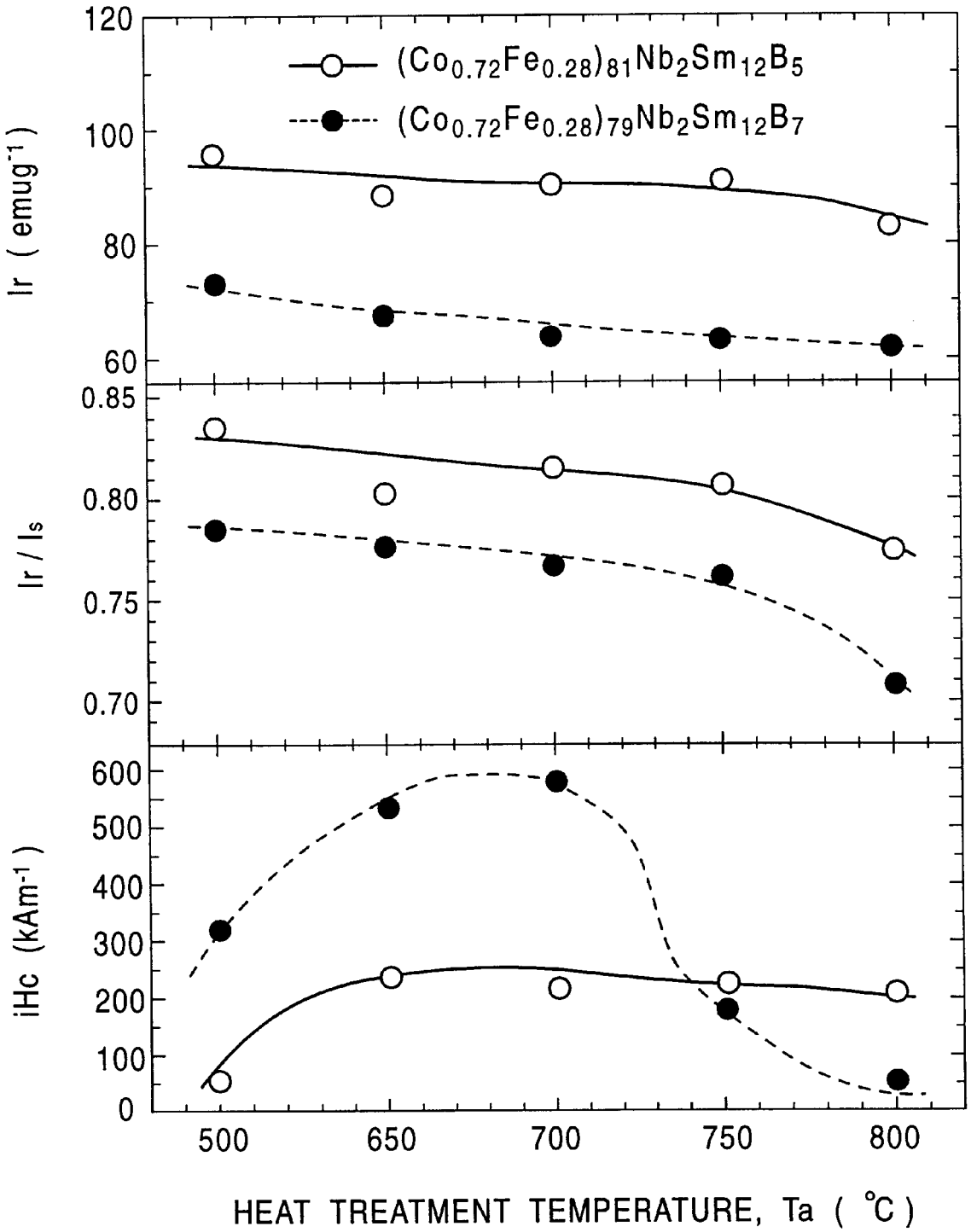
FIG. 32 is a graph showing the dependence of remanent magnetization (Ir), remanence ratio (Ir/Is) and coercive force (iHc) on heat treatment temperature of a quenched ribbon having each of the compositions $(Co_{0.72}Fe_{0.28})_{81}Nb_2Sm_{12}B_5$ and $(Co_{0.72}Fe_{0.28})_{79}Nb_2Sm_{12}B_7$.

FIG. 32 shows the magnetic characteristics of the ribbon samples obtained by heat treatment of the quenched ribbons having the compositions $(Co_{0.72}Fe_{0.28})_{81}Nb_2Sm_{12}B_5$ and $(Co_{0.72}Fe_{0.28})_{79}Nb_2Sm_{12}B_7$ at 600 to 800° C. for 3 minutes.

FIG. 32 indicates that in the case of a heat treatment temperature of 700° C., coercive force (iHc) becomes maximum, and thus a heat treatment temperature of 700° C. is optimum for coercive force (iHc). Along with the results shown in FIG. 31, consideration indicates that this is possibly caused by appropriate precipitation and grain growth of the $(Fe, Co)_{17}Sm_2$ phase as a hard magnetic phase at a heat treatment temperature of 700° C., with the hard magnetic characteristics thereby improved.

In the case of a heat treatment temperature of less than 700° C. or over 700° C., the coercive force is low. This is due to the fact that at less than 700° C., the amount of precipitation of the $(Fe, Co)_{17}Sm_2$ phase is smaller than the residual amorphous phase (soft magnetic phase), thereby exhibiting insufficient hard magnetic characteristics, and at over 700° C., crystal grains comprising the $(Fe, Co)_{20}Sm_3B$ phase are enlarged, thereby deteriorating hard magnetic characteristics. Such a relationship between coercive force and heat treatment temperature is particularly apparent in the case of the composition $(Co_{0.72}Fe_{0.28})_{79}Nb_2Sm_{12}B_7$.

The relation between the heat treatment temperature and the crystal grain size of the $(Fe, Co)_{17}Sm_2$ phase can be estimated from the results shown in FIGS. 30 and 31. Namely, although, in the ribbon sample having the composition $(Co_{0.72}Fe_{0.28})_{79}Nb_2Sm_{12}B_7$, an exothermic peak is observed near 657° C., and thus the $(Fe, Co)_{20}Sm_3B$ phase is thought to be precipitated (FIG. 31), the $(Fe, Co)_{20}Sm_3B$ phase is not observed in the diffraction pattern of the sample which experienced heat treatment at 700° C., as shown in FIG. 30. It is thus thought that at less than 700° C., the crystal grains of the $(Fe, Co)_{20}Sm_3B$ phase as a soft magnetic phase are small in the size and the amount of precipitation.

On the other hand, as shown in FIG. 30, many diffraction peaks of the (Fe, Co)$_{20}$Sm$_3$B phase are observed in the diffraction pattern of the sample, which experienced heat treatment at 800° C., and thus it can easily be estimated that crystal grains of the (Fe, Co)$_{20}$Sm$_3$B phase are enlarged to increase the amount of precipitation. This is thought to be a cause of deterioration in hard magnetic characteristics.

In FIG. 32, remanent magnetization (Ir) and remanence ratio (Ir/Is) gradually decrease as the heat treatment temperature increases, but little change, and thus they are little affected by the heat treatment temperature as compared with the coercive force (iHc).

Although, in the case of a heat treatment temperature of 700° C., the remanent magnetization (Ir) and remanence ratio (Ir/Is) are slightly lower than the case of a heat treatment temperature of 500° C., the coercive force (iHc) in the case of 700° C. becomes maximum. Therefore, the heat treatment temperature optimum for the ribbon samples having the above compositions is thought to be 700° C.

Figure 33:
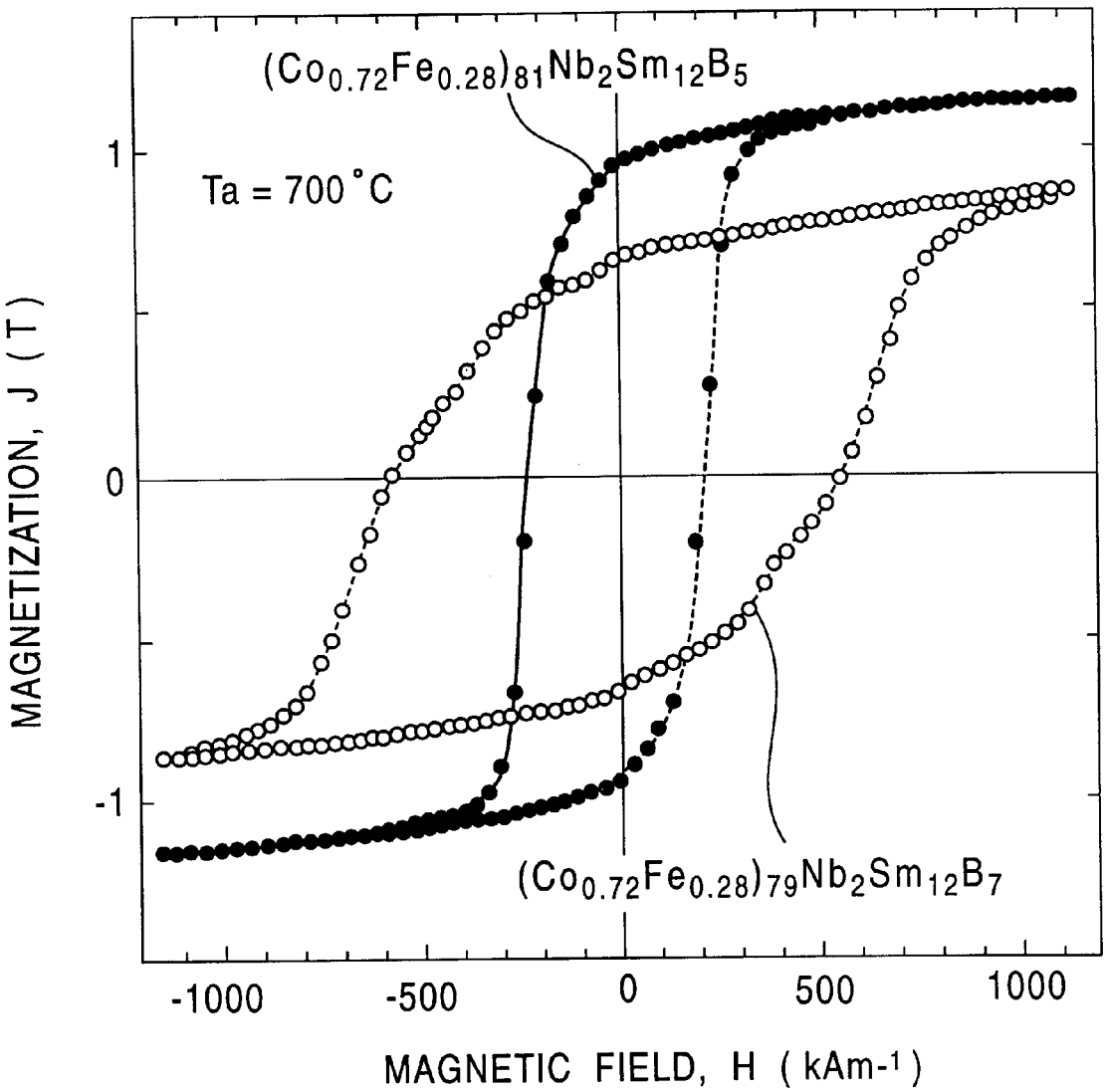
FIG. 33 is a graph showing a magnetization curve (B-H loop) of a quenched ribbon having each of the compositions $(Co_{0.72}Fe_{0.28})_{81}Nb_2Sm_{12}B_5$ and $(CO_{0.66}Fe_{0.34})_{79}Nb_2Sm_{12}B_7$.

FIG. 33 shows the magnetization curve (BH loop) of the ribbon sample obtained by heat treatment of each of the quenched ribbons having the compositions $(Co_{0.72}Fe_{0.28})_{81}Nb_2Sm_{12}B_5$ and $(Co_{0.72}Fe_{0.28})_{79}Nb_2Sm_{12}B_7$ at 700° C. for 3 minutes to precipitate a fine crystalline phase.

In the magnetization curves shown in FIG. 33, no specific inflection point such as a step or the like is observed, and the same magnetization curves as a magnetic material comprising a single hard magnetic phase are obtained. This is possibly caused by the fact that in the hard magnetic material of the present invention, the soft magnetic phase and the hard magnetic phase are mixed, but the magnetization rotation of the fine soft magnetic phase is magnetically coupled with the fine hard magnetic phase, and strongly constrained by the hard magnetic phase.

Therefore, the hard magnetic material of the present invention has characteristics which show the same magnetization curve as a magnetic material comprising a single hard magnetic phase, i.e., exchange coupling characteristics (exchange spring characteristics), and thus exhibits excellent hard magnetic characteristics.

Example 8

Quenched ribbons having the composition $(Co_{0.72}Fe_{0.28})_{98-y-t}Nb_2Sm_xB_y$ (wherein y=11 to 16 atomic %, t=3 to 9 atomic %) were obtained by the same method as Example 1.

Each of the quenched ribbons was subjected to heat treatment in a infrared image furnace of $5\times10^{-5}$ Pa or less under conditions in which the heating rate was 3 K/min, the heat treatment temperature (Ta) was 700° C., and the holding time was 3 minutes to obtain a ribbon sample in which a fine crystalline phase was precipitated.

Figure 34:
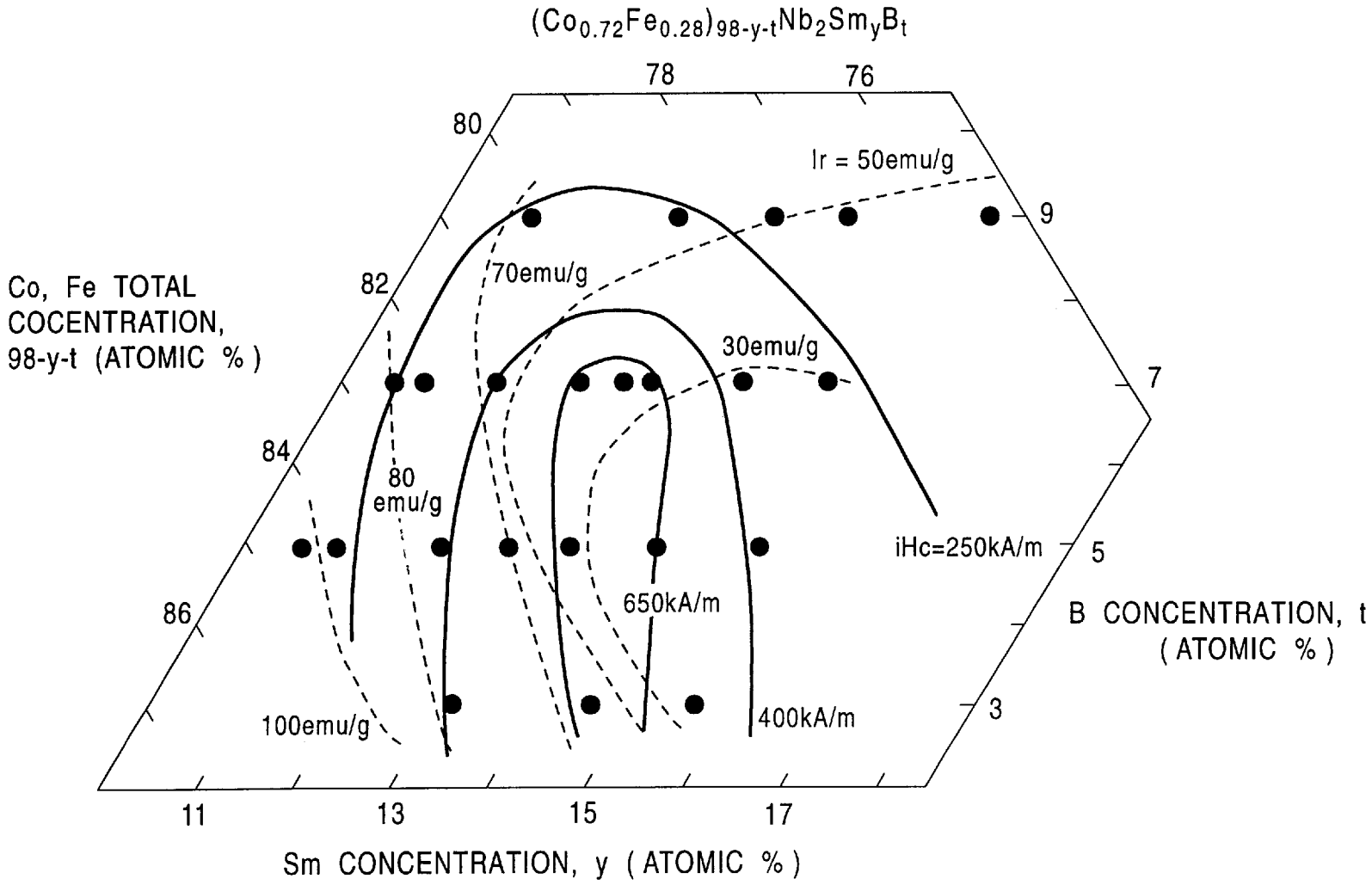
FIG. 34 is a graph showing coercive force (iHc) and remanent magnetization (Ir) of a ribbon sample having the composition $(Co_{0.72}Fe_{0.28})_{98-y-t}Nb_2Sm_xB_y$ (y=11 to 16 atomic %, and t=3 to 9 atomic %)
Figure 35:
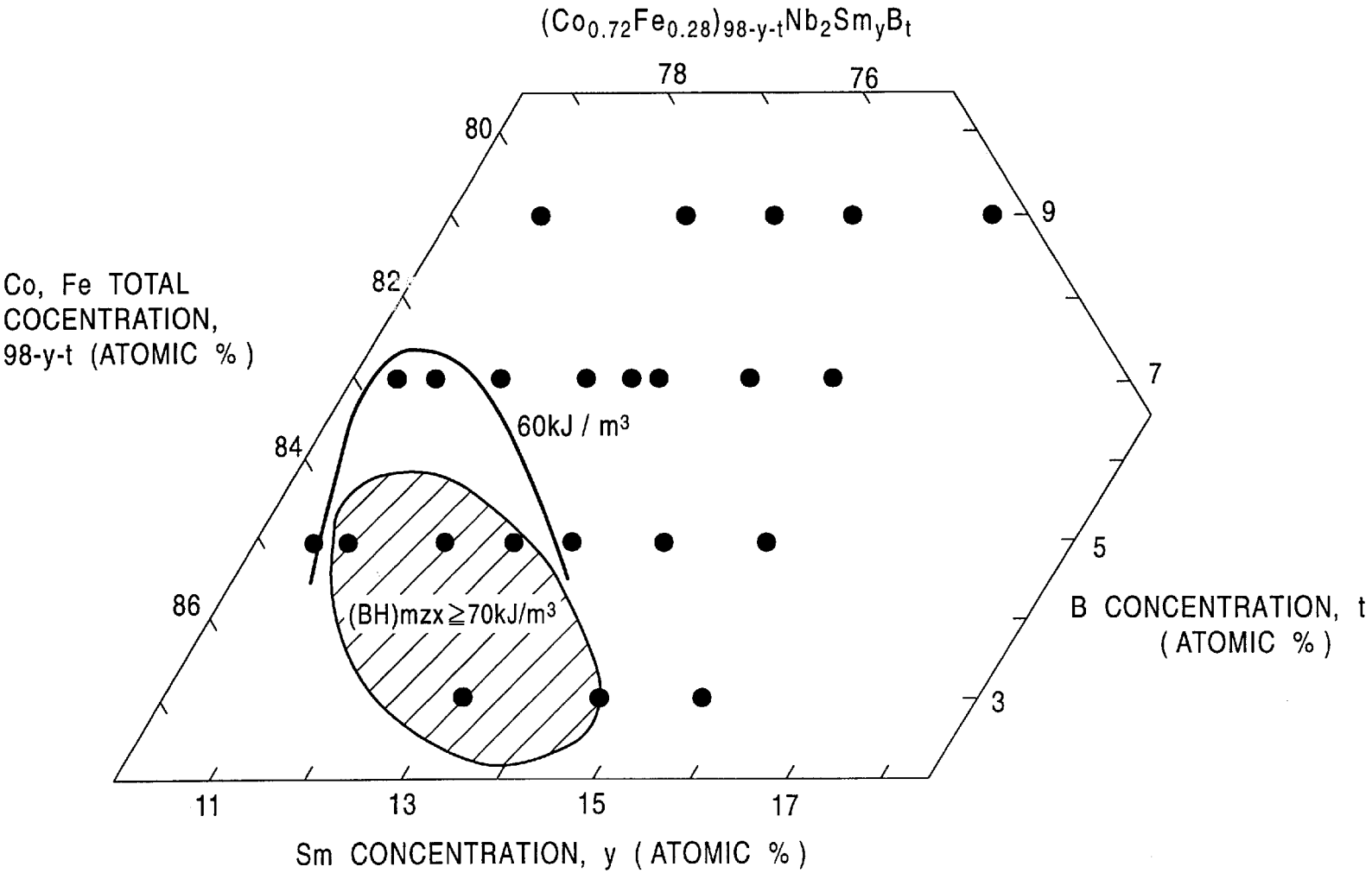
FIG. 35 is a graph showing the maximum eneryg product $((BH)_{max})$ of a ribbon sample having the composition $(Co_{0.72}Fe_{0.28})_{98-y-t}Nb_2Sm_xB_y$ (y=11 to 16 atomic %, and t=3 to 9 atomic %)

FIGS. 34 and 35 show the relations between the compositions of these ribbon samples, and coercive force (iHc), remanent magnetization (Ir) and maximum magnetic energy product ($(BH)_{max}$).

FIG. 34 indicates that in the case of the composition which satisfies y+t=18 atomic % (the total of Sm and B), a coercive force (iHc) of as high as 650 kA/m or more is obtained. It is thus found that the addition of B permits achievement of high coercive force even at a relatively low Sm concentration.

FIG. 35 reveals that in the composition $(Co_{0.72}Fe_{0.28})_{98-y-t}Nb_2Sm_xB_y$, when at least 13 atomic % $\leqq$ y $\leqq$ 15 atomic % and 3 atomic % $\leqq$ t $\leqq$ 7 atomic %, a maximum magnetic energy product $((BH)_{max}) \geqq 60$ kJ m$^3$ can be obtained, and when 11 atomic % $\leqq$ y $\leqq$ 15 atomic % and 3 atomic % $\leqq$ t $\leqq$ 5 atomic %, a maximum magnetic energy product $((BH)_{max}) \geqq 70$ kJ/m$^3$ can be obtained, with excellent hard magnetic characteristics.

Example 9

A quenched ribbon having the composition $(Co_{0.72}Fe_{0.28})_{79}Nb_2Sm_{12}B_7$ was obtained by the same method as Example 1.

The quenched ribbon was subjected to heat treatment in a infrared image furnace of $5\times10^{-5}$ Pa or less under conditions in which the heating rate was 3 K/min, the heat treatment temperature (Ta) was 700° C., and the holding time was 3 minutes to obtain a ribbon sample in which a fine crystalline phase was precipitated.

Figure 36:
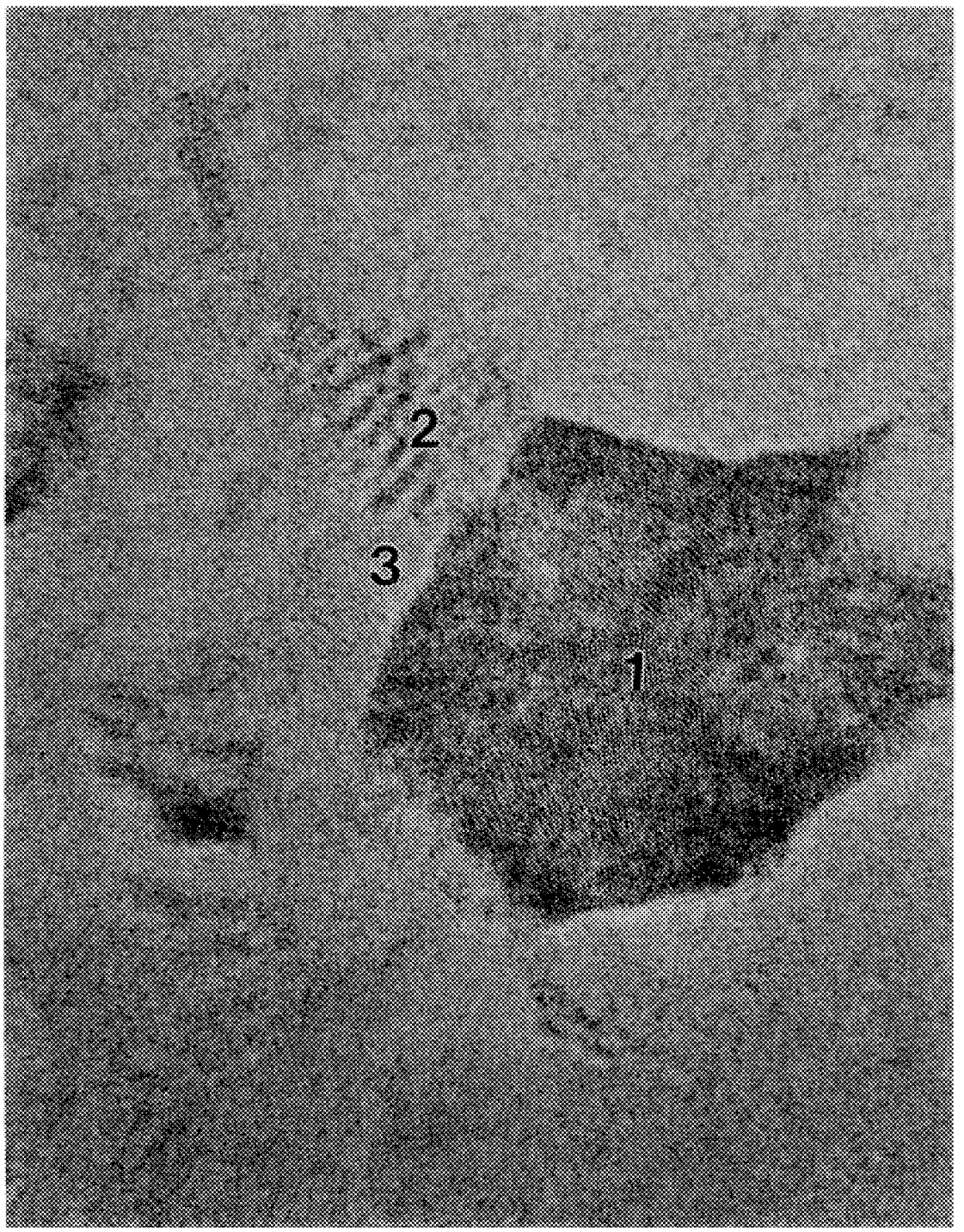
FIG. 36 is a transmission type electron microscope (TEM) photograph a ribbon sample having the composition $(Co_{0.72}Fe_{0.28})_{79}Nb_2Sm_{12}B_7$.

The texture of the ribbon sample was observed by a transmission electron microscope (TEM). FIG. 36 shows a TEM photograph of the texture.

Also the atomic arrangements in portions near reference numerals 1, 2 and 3 shown in FIG. 36 were analyzed by electron beam diffraction. The results are shown in FIGS. 37 to 39.

Figure 37:
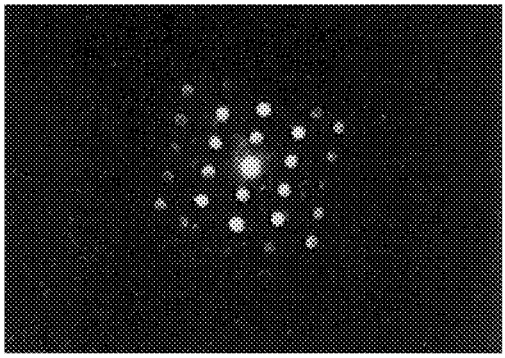
FIG. 37 is a drawing showing the results of electron beam diffraction of the crystalline phase 1 shown in FIG. 36.
Figure 38:
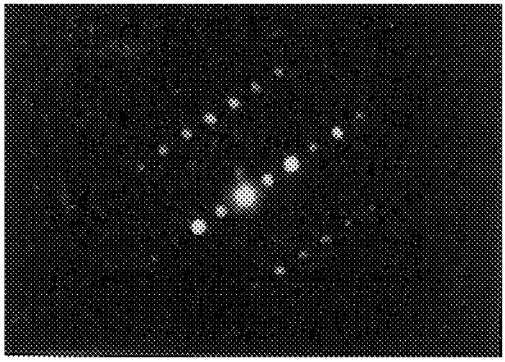
FIG. 38 is a drawing showing the results of electron beam diffraction of the crystalline phase 2 shown in FIG. 36.
Figure 39:
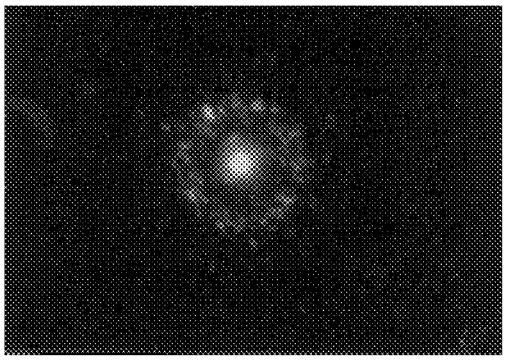
FIG. 39 is a drawing showing the results of electron beam diffraction of the amorphous phase 3 shown in FIG. 36.

As can be seen from the distribution states of the diffraction spots of electron beam diffraction shown in FIGS. 37 to 39, each of the portions near reference numerals 1 and 2 is a crystalline phase, and the portion near reference numeral 3 is an amorphous phase (the amorphous phase 3). The crystalline phase (the crystalline phase 1) near reference numeral 1 had an average crystal grain size of about 60 nm, and the crystalline phase (the crystalline phase 2) near reference numeral 2 had a crystal grain size of about 20 nm. The reason why the crystal grain size of the crystalline phase 1 is larger than that of the crystalline phase 2 is possible that the crystalline phase 1 precipitates earlier than the crystalline phase 2.

The compositions of the crystalline phase 1, the crystalline phase 2 and the amorphous phase 3 were analyzed by energy dispersive spectrometry (EDS). The results are shown in Table 6. Table 6 indicates that both the crystalline phases 1 and 2 are hard magnetic phases and comprise the (Fe, Co)$_{17}$Sm$_2$ phase. Also, comparison between the crystalline phases 1 and 2 and the amorphous phase 3 indicates that Nb is concentrated in the amorphous phase 3.

TABLE 6

| Analytical position | Fe (atomic %) | Co (atomic %) | Sm (atomic %) | Nb (atomic %) |
|---|---|---|---|---|
| Crystalline phase 1 | 23.0 | 64.6 | 12.1 | 0.3 |
| Crystalline phase 2 | 27.4 | 62.8 | 8.0 | 1.8 |
| Amorphous phase 3 | 9.6 | 72.4 | 13.8 | 4.2 |

Example 10

Quenched ribbons having the compositions $(Co_{0.72}Fe_{0.28})_{83-x}Sm_{12}Nb_xB_5$, $(Co_{0.72}Fe_{0.28})_{81-x}Sm_{12}Nb_xB_7$ and $(Co_{0.72}Fe_{0.28})_{80-x}Sm_{13}Nb_xB_7$ (wherein x=0 to 4 atomic %) were obtained by the same method as Example 1.

Each of the quenched ribbons was subjected to heat treatment in a infrared image furnace of $5\times10^{-5}$ Pa or less under conditions in which the heating rate was 3 K/min, the heat treatment temperature (Ta) was 700° C., and the holding time was 3 minutes to obtain a ribbon sample in which a fine crystalline phase was precipitated. For each of the ribbon samples, the relations between the Nb concentration (x) and magnetic characteristics are shown in FIG. 40.

Figure 40:
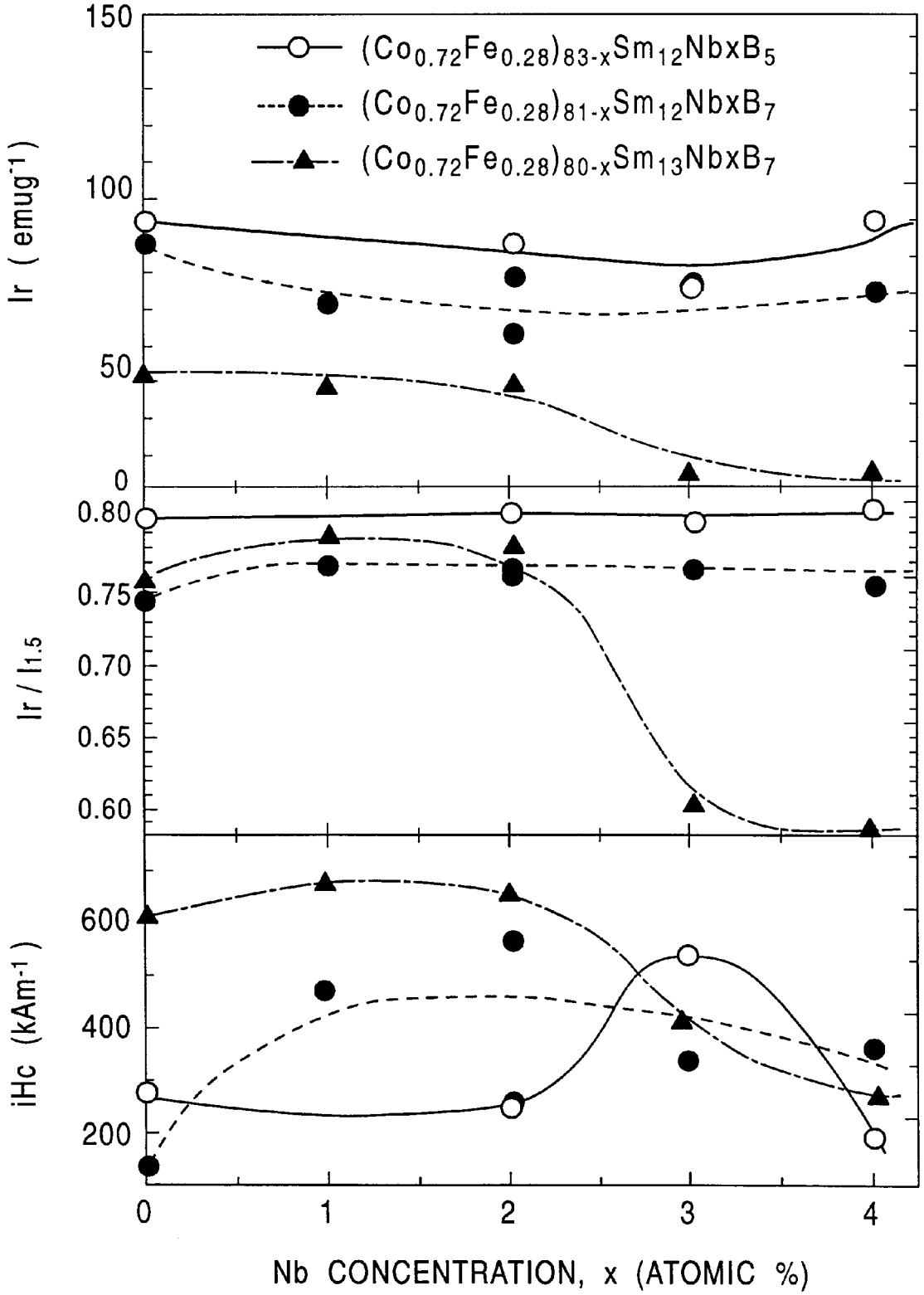
FIG. 40 a graph showing the dependence of remanent magnetization (Ir), remanence ratio $(Ir/I_{1.5})$ and coercive force (iHc) on the Nb concentration of a bulk sample having a cubic form of 4×4×4 mm and each of the compositions $(Co_{0.72}Fe_{0.28})_{81}Sm_{12}Nb_2B_5$, $(Co_{0.72}Fe_{0.28})_{79}Sm_{12}Nb_2B_7$ and $(Co_{0.72}Fe_{0.28})_{80}Sm_{13}Nb_2B_5$.

FIG. 40 indicates that the addition of 1 to 2 atomic % of Nb improves hard magnetic characteristics.

Example 11

A cubic bulk sample having a size of 4×4×4 mm was obtained by the same method as Example 4 except that the composition was each of $(Co_{0.72}Fe_{0.28})_{81}Sm_{12}Nb_2B_5$, $(Co_{0.72}Fe_{0.28})_{79}Sm_{12}Nb_2B_7$ and $(Co_{0.72}Fe_{0.28})_{80}Sm_{13}Nb_2B_5$.

Table 7 shows the densities and the magnetic characteristics in the Z direction (the direction of application of pressure) of the thus-obtained bulk samples.

Table 7 reveals that each of the ribbon samples has a remanence ratio ($Ir/I_{1.5}$) of 0.7 or more, magnetization ($I_{1.5}$) of 0.82 to 0.91 (T), remanent magnetization (Ir) of 0.63 to 0.65 (T), coercive force (iHc) of 7.1 to 17.4 (kOe), and a maximum magnetic energy product ((BH)max) of 55 to 66 $kJ/m^3$, and thus exhibits excellent hard magnetic characteristics.

TABLE 7

| Composition | Density ($gcm^{-3}$) | $I_{1.5}$ (T) | Ir (T) | $Ir/I_{1.5}$ | iHc (kOe) | $(BH)_{max}$ ($kJm^{-3}$) |
|---|---|---|---|---|---|---|
| $(Co_{0.72}Fe_{0.28})_{81}Sm_{12}Nb_2B_5$ | 7.50 | 0.91 | 0.65 | 0.71 | 7.1 | 55 |
| $(Co_{0.72}Fe_{0.28})_{79}Sm_{12}Nb_2B_7$ | 8.0 | 0.87 | 0.64 | 0.74 | 14.4 | 67 |
| $(Co_{0.72}Fe_{0.28})_{80}Sm_{13}Nb_2B_5$ | 7.85 | 0.82 | 0.63 | 0.77 | 17.4 | 66 |

What is claimed is:

1. A hard magnetic material comprising Co as a main component, at least one element Q of P, C, Si and B, and at least 8 atomic % Sm, and an amorphous phase and a fine crystalline phase.

2. The hard magnetic material of claim 1, prepared by heating an alloy powder, and then consolidating the alloy.

3. The hard magnetic material according to claim 2, wherein the consolidating is by a softening phenomenon which occurs in crystallization reaction of an amorphous phase.

4. The hard magnetic material according to claim 1, comprising 50% by volume or more of fine crystalline phase having an average crystal grain size of 100 nm or less.

5. The hard magnetic material according to claim 1, comprising a soft magnetic phase and a hard magnetic phase.

6. The hard magnetic material according to claim 5, wherein the soft magnetic phase contains at least one of a bcc-Fe phase, a bcc-(FeCo) phase, a $D_{20}E_3Q$ phase containing dissolved atoms, and the residual amorphous phase, and the hard magnetic phase contains at least a $E_2D_{17}$ phase containing dissolved atoms;

wherein D is at least one element of the transition metals, E is at least one element of Sm, Sc, Y, La, Ce, Pr, Pm, Nd, Eu, Gd, Tb, Dy, Ho, Er, Tm, Yb and Lu, and Q is at least one of P, C, Si and B.

7. The hard magnetic material according to claim 6, wherein the crystal axis of the hard magnetic phase is oriented to impart magnetic anisotropy.

8. The hard magnetic material according to claim 4 wherein the ratio Ir/Is of remanent magnetization Ir to saturation magnetization Is is 0.6 or more.

9. The hard magnetic material according to claim 7, wherein the ratio Ir/Is of remanent magnetization Ir to saturation magnetization Is is 0.6 or more.

10. The hard magnetic material according to claim 6, further comprising Nb.

11. A hard magnetic material comprising:

Co as a main component;

at least one element Q of P, C, Si and B;

at least 8 atomic % Sm;

at least one element of at least one element M of Nb, Zr, Ta and Hf, at least one element R of Sc, Y, La, Ce, Pr, Nd, Pm, Eu, Gd, Tb, Dy, Ho, Er, Tm, Yb and Lu, and at least one element X of Al, Ge, Ga, Cu, Ag, Pt and Au; and an amorphous phase and a fine crystalline phase.

12. The hard magnetic material of claim 11 prepared by heating an alloy powder, and then consolidating the alloy.

13. The hard magnetic material according to claim 12, wherein the consolidating is by a softening phenomenon which occurs in crystallization reaction of an amorphous phase.

14. The hard magnetic material according to claim 11, comprising 50% by volume or more of fine crystalline phase having an average crystal grain size of 100 nm or less.

15. The hard magnetic material according to claim 11, comprising a soft magnetic phase and a hard magnetic phase.

16. The hard magnetic material according to claim 15, wherein the soft magnetic phase contains at least one of a bcc-Fe phase, a bcc-(FeCo) phase, a $D_{20}E_3Q$ phase containing dissolved atoms, and the residual amorphous phase, and the hard magnetic phase contains at least a $E_2D_{17}$ phase containing dissolved atoms;

wherein D is at least one element of the transition metals, E is at least one element of Sm, Sc, Y, La, Ce, Pr, Pm, Nd, Eu, Gd, Tb, Dy, Ho, Er, Tm, Yb and Lu, and Q is at least one of P, C, Si and B.

17. The hard magnetic material according to claim 16, wherein the crystal axis of the hard magnetic phase is oriented to impart magnetic anisotropy.

18. The hard magnetic material according to claim 14, wherein the ratio Ir/Is of remanent magnetization Ir to saturation magnetization Is is 0.6 or more.

19. The hard magnetic material according to claim 17, wherein the ratio Ir/Is of remanent magnetization Ir to saturation magnetization Is is 0.6 or more.

20. The hard magnetic material according to claim 16, wherein the at least one element M comprises Nb.

21. The hard magnetic material according to claim 1, represented by the following composition formula:

$$(Co_{1-f}T_f)_{100-x-y-z-t}M_xSm_yR_zQ_t$$

wherein T is at least one element of Fe and Ni, M is at, least one element of Nb, Zr, Ta, and Hf, R is at least one element of Sc, Y, La, Ce, Pr, Nd, Pm, Eu, Gd, Tb, Dy, Ho, Er, Tm, Yb, and Lu other than Sm, Q is at least one element of P, C, Si, and B, $0 \leqq f < 0.5$, 0 atomic $\% \leqq x4 \leqq$ atomic %, 8 atomic $\% \leqq y \leqq 16$ atomic %, 0 atomic $\% \leqq z \leqq 5$ atomic %, 0.5 atomic $\% \leqq t \leqq 10$ atomic %, and 8 atomic $\% \leqq x+y+z \leqq 16$ atomic %.

22. The hard magnetic material according to claim 1, represented by the following composition formula:

$$(Co_{1-f}T_f)_{100-x-y-z-t-u}M_xSm_yR_zQ_tX_u$$

wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu other than Sm, Q is at least one element of P, C, Si, and B, X is at least one element of Al, Ge, Ga, Cu, Ag, Pt, and Au, $0 \leqq f < 0.5$, 0 atomic $\% \leqq x4 \leqq$ atomic %, 8 atomic $\% \leqq y \leqq 16$ atomic %, 0 atomic $\% \leqq z \leqq 5$ atomic %, 0.5 atomic $\% \leqq t \leqq 10$ atomic %, 0 atomic $\% \leqq u \leqq 5$ atomic %, and 8 atomic $\% \leqq x+y+z \leqq 16$ atomic %.

23. The hard magnetic material according to claim 21, wherein the composition ratio f is in the range of $0.2 \leqq f < 0.5$.

24. The hard magnetic material according to claim 22, wherein the composition ratio f is in the range of $0.2 \leqq f < 0.5$.

25. The hard magnetic material according to claim 11, represented by the following composition formula:

$$(Co_{1-f}T_f)_{100-x-y-z-t}M_xSm_yR_zQ_t$$

wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu other than Sm, Q is at least one element of P, C, Si, and B, $0 \leqq f < 0.5$, 0 atomic $\% \leqq x4 \leqq$ atomic %, 8 atomic $\% \leqq y \leqq 16$ atomic %, 0 atomic $\% \leqq z \leqq 5$ atomic %, 0.5 atomic $\% \leqq t \leqq 10$ atomic %, and 8 atomic $\% \leqq x+y+z \leqq 16$ atomic %.

26. The hard magnetic material according to claim 11, represented by the following composition formula:

$$(Co_{1-f}T_f)_{100-x-y-z-t-u}M_xSm_yR_zQ_tX_u$$

wherein T is at least one element of Fe and Ni, M is at least one element of Nb, Zr, Ta, and Hf, R is at least one element of Sc, Y, La, Ce, Pr, Nd, Pm, Eu, Gd, Tb, Dy, Ho, Er, Tm, Yb, and Lu other than Sm, Q is at least one element of P, C, Si, and B, X is at least one element of Al, Ge, Ga, Cu, Ag, Pt, and Au, $0 \leqq f < 0.5$, 0 atomic $\% \leqq x\ 4 \leqq$ atomic %, 8 atomic $\% \leqq y \leqq 16$ atomic %, 0 atomic $\% \leqq z \leqq 5$ atomic %, 0.5 atomic $\% \leqq t \leqq 10$ atomic %, 0 atomic $\% \leqq u \leqq 5$ atomic %, and 8 atomic $\% \leqq x+y+z \leqq 16$ atomic %.

27. The hard magnetic material according to claim 25, wherein the composition ratio f is in the range of $0.2 \leqq f \leqq 0.5$.

28. The hard magnetic material according to claim 26, wherein the composition ratio f is in the range of $0.2 \leqq f < 0.5$.

* * * * *

UNITED STATES PATENT AND TRADEMARK OFFICE

CERTIFICATE OF CORRECTION

PATENT NO. : 6,235,129 B1
DATED : May 22, 2001
INVENTOR(S) : Akinori Kojima et al.

It is certified that error appears in the above-identified patent and that said Letters Patent is hereby corrected as shown below:

Title page,
Item [73], Assignee:, after "Alps Electric Co., Ltd.", insert -- Tokyo, (JP) and Akihisa Inoue, Miyagi-ken, --.
Item [74], *Attorney, Agent, or Firm,* change "Holfer" to -- Hofer --.

Column 24,
Line 7, delete "at least one element of"
Line 60, after "at" delete "," (comma)

Signed and Sealed this

Ninth Day of July, 2002

*Attest:*

*Attesting Officer*

JAMES E. ROGAN
*Director of the United States Patent and Trademark Office*